US005475365A

United States Patent [19]

Hoseit et al.

[11] Patent Number: 5,475,365

[45] Date of Patent: Dec. 12, 1995

[54] METHODS AND APPARATUS FOR INTRUSION DETECTION HAVING IMPROVED IMMUNITY TO FALSE ALARMS

[75] Inventors: Paul M. Hoseit, El Dorado Hills; Gordon S. Whiting, Orangevalle, both of Calif.

[73] Assignee: C & K Systems, Inc., Folsom, Calif.

[21] Appl. No.: 348,759

[22] Filed: Dec. 2, 1994

Related U.S. Application Data

[63] Continuation of Ser. No. 11,647, Jan. 28, 1993, abandoned.

[51] Int. Cl.[6] ..... G08B 19/00

[52] U.S. Cl. ..... 340/522; 340/508; 340/523; 340/526; 340/541; 340/552; 340/565; 367/94

[58] Field of Search ..... 340/508, 522, 340/523, 526, 506, 541, 565, 552; 367/93, 94

[56] References Cited

U.S. PATENT DOCUMENTS

| | | | |
|---|---|---|---|
| 3,074,053 | 1/1963 | McDonough et al. | 340/258 |
| 3,242,486 | 3/1966 | Corbell | 343/7 |
| 3,573,817 | 4/1971 | Akers | 340/420 |
| 3,725,888 | 4/1973 | Solomon | 340/258 A |
| 3,801,978 | 4/1974 | Gershberg et al. | 340/258 A |
| 3,967,283 | 6/1976 | Clark et al. | 343/7.7 |
| 3,979,740 | 9/1976 | Forbat et al. | 340/522 |
| 4,117,464 | 9/1978 | Lutz | 340/554 |
| 4,134,109 | 1/1979 | McCormick et al. | 340/550 |
| 4,222,041 | 9/1980 | Von Tomkewitsch et al. | 340/517 |
| 4,342,987 | 8/1982 | Rossin | 340/567 |
| 4,364,030 | 12/1982 | Rossin | 340/567 |
| 4,377,808 | 3/1983 | Kao | 340/522 |
| 4,401,976 | 8/1983 | Stadelmayr | 340/522 |
| 4,410,884 | 10/1983 | Heiland | 340/545 |
| 4,437,089 | 3/1984 | Archard | 340/541 |
| 4,468,657 | 8/1984 | Rossin | 340/555 |
| 4,468,658 | 8/1984 | Rossin | 340/567 |
| 4,482,889 | 11/1984 | Tsuda et al. | 340/514 |
| 4,611,197 | 9/1986 | Sansky | 340/522 |
| 4,625,199 | 11/1986 | Pantus | 340/522 |
| 4,660,024 | 4/1987 | McMaster | 340/522 |
| 4,668,941 | 5/1987 | Davenport et al. | 340/550 |
| 4,710,750 | 12/1987 | Johnson | 340/522 |
| 4,772,875 | 9/1988 | Maddox et al. | 340/522 |
| 4,853,677 | 8/1989 | Yarbrough et al. | 340/544 |
| 4,882,567 | 11/1989 | Johnson | 340/522 |
| 4,928,085 | 5/1990 | Durand, III et al. | 340/544 |
| 5,023,593 | 6/1991 | Brox | 340/522 |
| 5,057,817 | 10/1991 | Berube | 340/506 |
| 5,077,548 | 12/1991 | Dipoala | 340/506 |
| 5,107,249 | 4/1992 | Johnson | 340/541 |
| 5,276,427 | 1/1994 | Peterson | 340/506 |

FOREIGN PATENT DOCUMENTS

| | | |
|---|---|---|
| 0141987 | 10/1983 | European Pat. Off. . |
| 0487358 | 11/1991 | European Pat. Off. . |

*Primary Examiner*—John K. Peng
*Assistant Examiner*—Daniel J. Wu
*Attorney, Agent, or Firm*—Limbach & Limbach

[57] ABSTRACT

A multisensor intrusion detection system having greatly improved immunity to false alarms is disclosed. This system employs a first sensor for sensing an intrusion in a volume of space by a first physical phenomenon and a second sensor for detecting an intrusion in the volume of space by a second physical phenomenon different from the first physical phenomenon. The first sensor generates a first signal in response to the detection of an intrusion into the volume of space, and the second sensor generates a second signal in response to a detection of an intrusion. A microcontroller generates an alarm signal upon the occurrence of one first signal and one second signal within a first interval, the occurrence of another first signal within a subsequent second interval and the occurrence of another second signal within a third subsequent interval.

38 Claims, 13 Drawing Sheets

TO FIG. 1A

METHODS AND APPARATUS FOR INTRUSION DETECTION HAVING IMPROVED IMMUNITY TO FALSE ALARMS

This is a continuation of application Ser. No. 08/011,647, filed on Jan. 28, 1993, now abandoned.

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

BACKGROUND OF THE INVENTION

The present invention relates to an improved method and apparatus for detecting intrusions and more particularly to a method and apparatus that uses a plurality of sensors. The methods and apparatus of the present invention provide for improved immunity to false alarms.

Intrusion detection systems having a plurality of detectors to improve immunity to false alarms are well known in the art. For example, an intrusion detection system will typically use a passive infrared sensor directed to detect intrusion in a volume of space by sensing infrared radiation, and a microwave detector directed to detect intrusion in the same volume of space by sensing the frequency of reflected microwave radiation in comparison to the frequency of incident microwave radiation. When a signal is simultaneously generated by both of the sensors, signal processing circuitry gates the signals and generates an alarm signal.

Another example of an intrusion detection system employing a plurality of sensors is shown in U.S. Pat. No. 4,853,677 (see also U.S. Pat. No. 4,928,085). There, a single microphone detects both the audible sound of breaking glass and the subsonic sound of pressure on the glass being flexed both before and during breakage. Here again, although a single microphone is used, two different types of physical phenomena are detected (audible sound waves and low frequency pressure waves) to provide a detection system with greater immunity to false alarms.

U.S. Pat. No. 5,107,249 shows an intrusion detection system having a first sensor and a second sensor, with the second sensor being less susceptible to the generation of false alarms than the first sensor. When the second sensor detects an intrusion, the second sensor generates an output signal and this output signal is held. The held output signal is supplied to a logic gate that receives the signal directly from the first sensor. When the first sensor is activated within the period of time that the output signal is held, the logic gate generates an alarm signal. However, this solution is less than ideal because random events that trigger the second sensor will cause the system to become a single technology device for the period of time that the output signal is held. Worse yet, during the period of time that the output signal of the second sensor is held, the system effectively operates as a single technology system that is dependent upon the less reliable technology.

Accordingly, in the present invention, an improved intrusion detection system having a plurality of sensors that is more immune to false alarm generation is disclosed.

SUMMARY OF THE INVENTION

The present invention is directed toward a method and apparatus for a multiple sensor intrusion detection system having improved immunity to false alarms.

In one embodiment of the present invention, a first sensor consists of a microwave detector and a second sensor consists of a passive infrared detector. In this embodiment, an alarm sequence requires that both the microwave detector and the passive infrared detector each, in any order, sense an intrusion within a first interval. Then, within a second subsequent interval, the passive infrared detector must sense an intrusion, and then, within a third interval that is subsequent to the second interval, the microwave detector must sense an intrusion to thereby initiate an alarm. Depending upon the given volume of space and type of intrusion to be detected, the types of sensors used could be different from a passive infrared sensor and a microwave sensor. The type of first and second sensors most effective for a given volume of space will depend upon not only the environmental conditions of the volume of space but also upon the expected forms of intrusion into that space (that is, human, other mammal, reptile or robot). For example, to sense an intrusion by a robot in contrast to a warm blooded animal, it may be preferable to use as a first sensor a differential magnetic field sensor and a passive radio frequency signal detector as a second sensor.

Another aspect of the present invention includes a backup capability in the event any of the sensors or their associated circuitry become disabled. In the preferred embodiment of the invention, in the event either the microwave detector or the passive infrared detector is disabled, an alarm will still be initiated if, with respect to the still operative detector, an intrusion is repeatedly sensed within a predetermined interval.

A better understanding of the features and advantages of the present invention may be obtained by reference to the detailed description of the invention and the accompanying drawing that sets forth an illustrative embodiment in which the principles of the invention are used.

DETAILED DESCRIPTION OF THE DRAWING

Figure 1A:
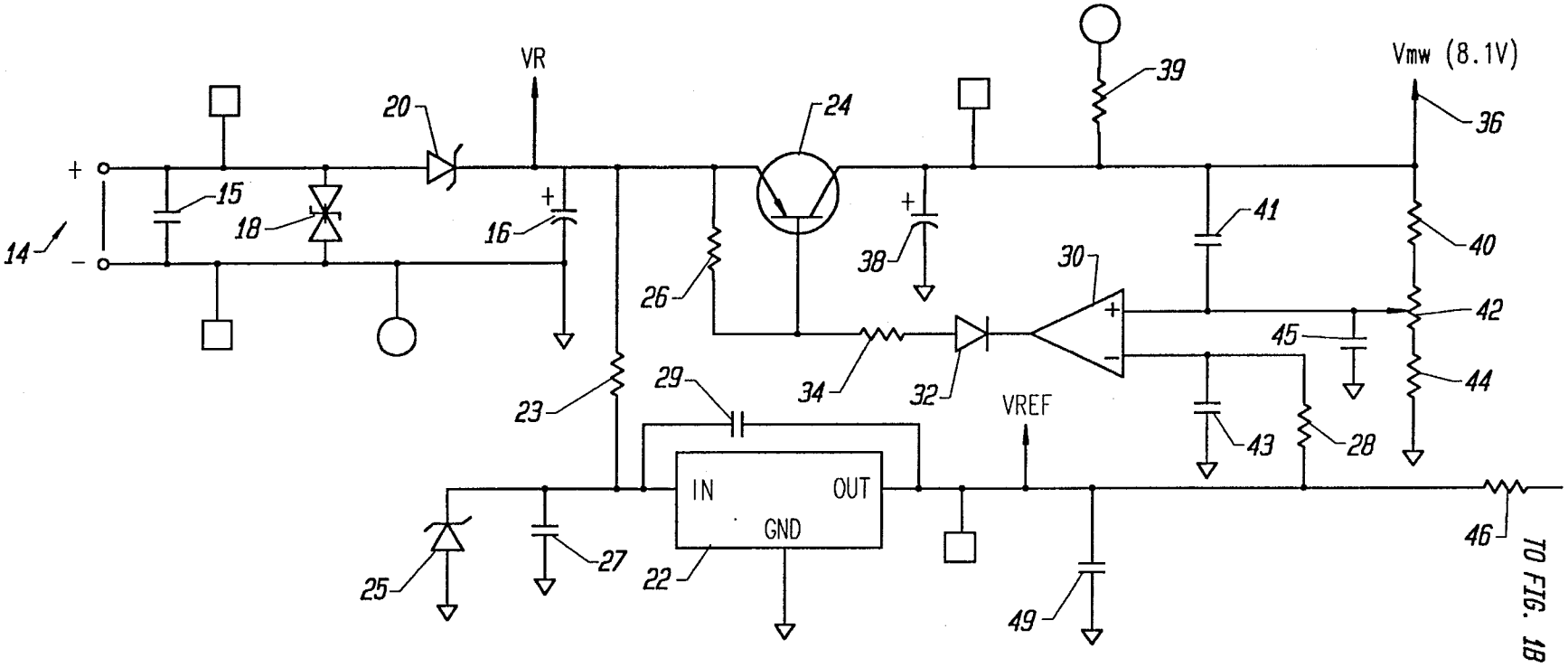
FIGS. 1(*a*), 1(*b*), 1(*c*), 1(*d*), 1(*e*), 1(*f*), 1(*g*), 1(*h*), 1(*i*), and 1(*j*) are a detailed schematic diagram of the preferred embodiment of the improved intrusion detection system of the present invention.
Figure 1B:
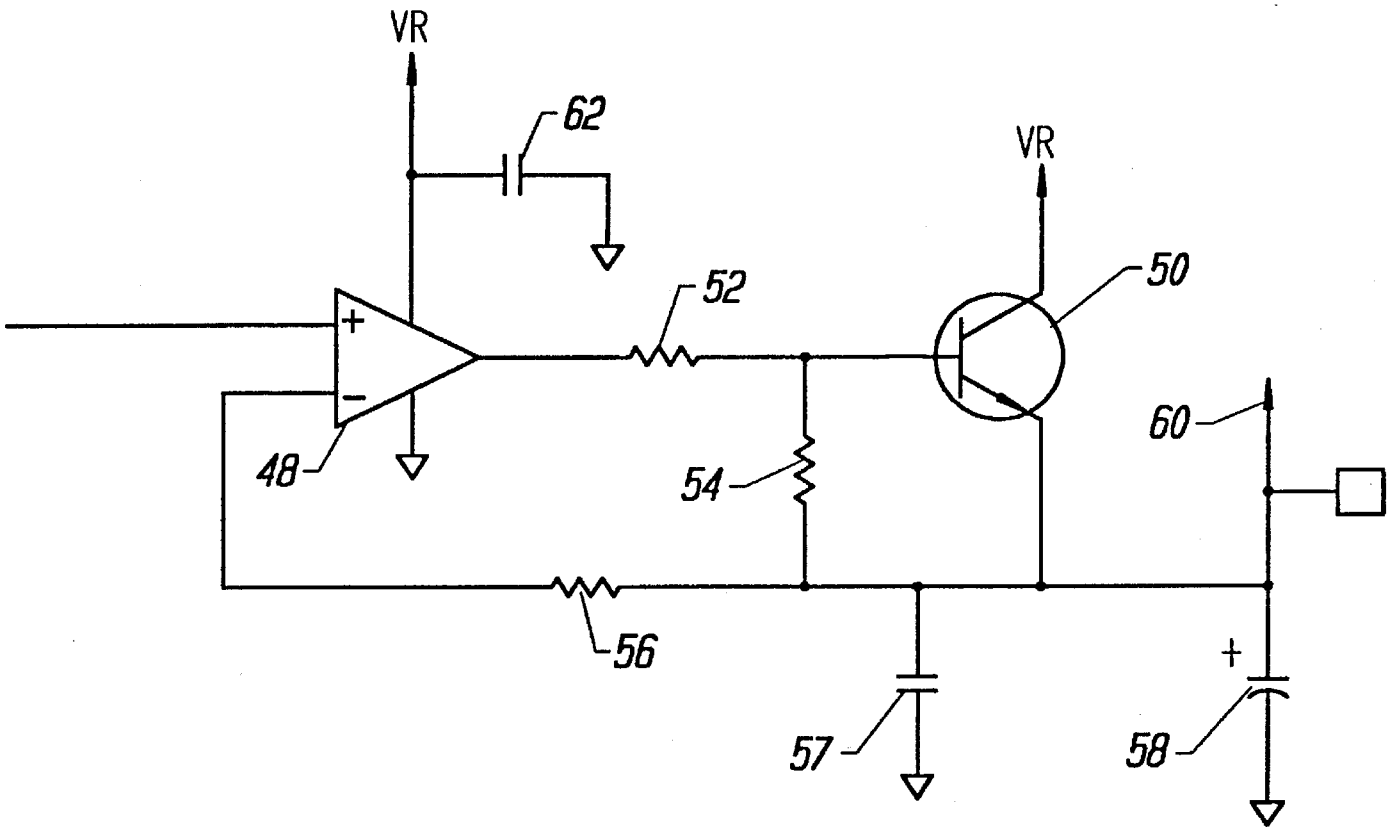
Figure 1C:
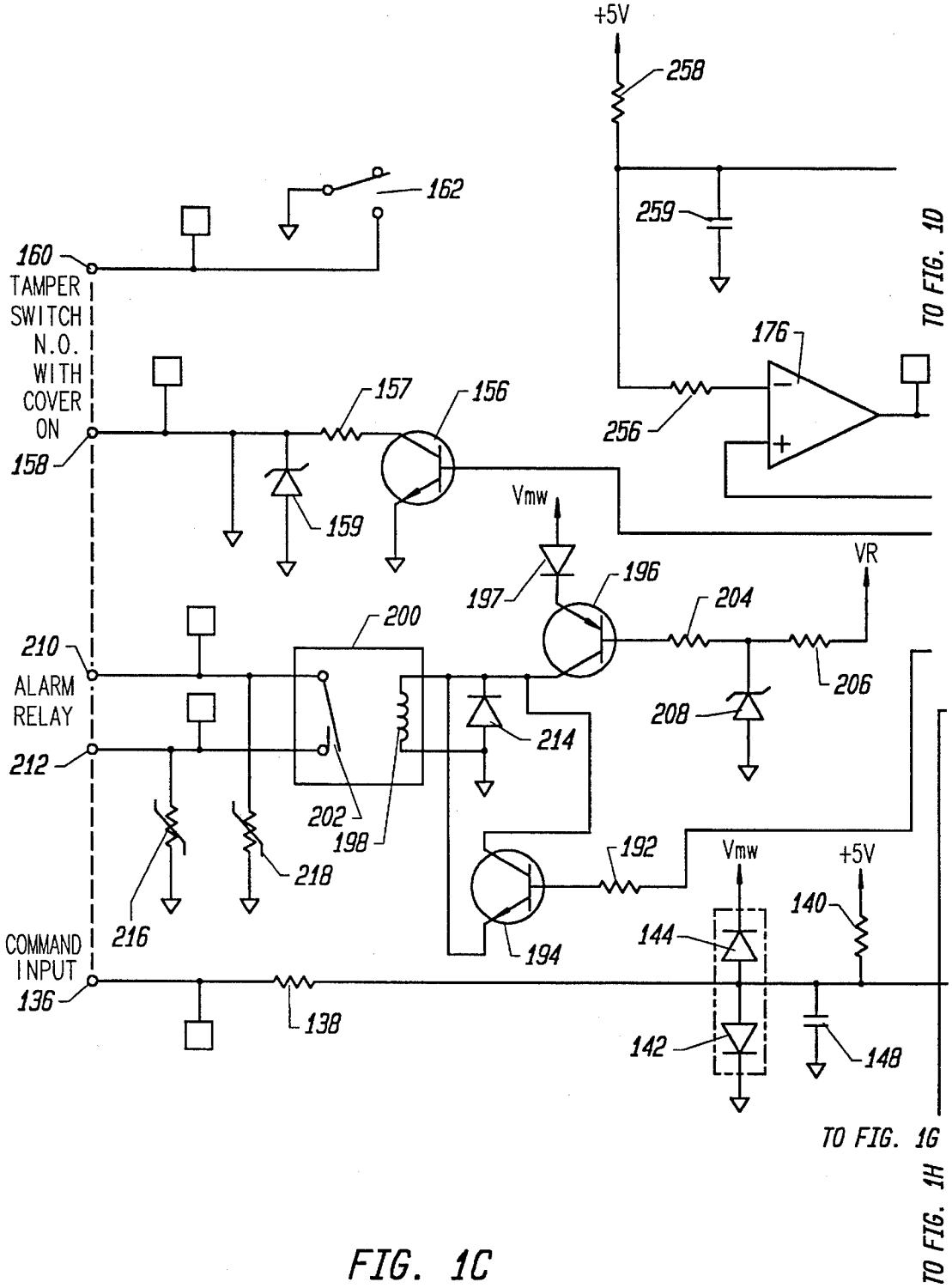
Figure 1D:
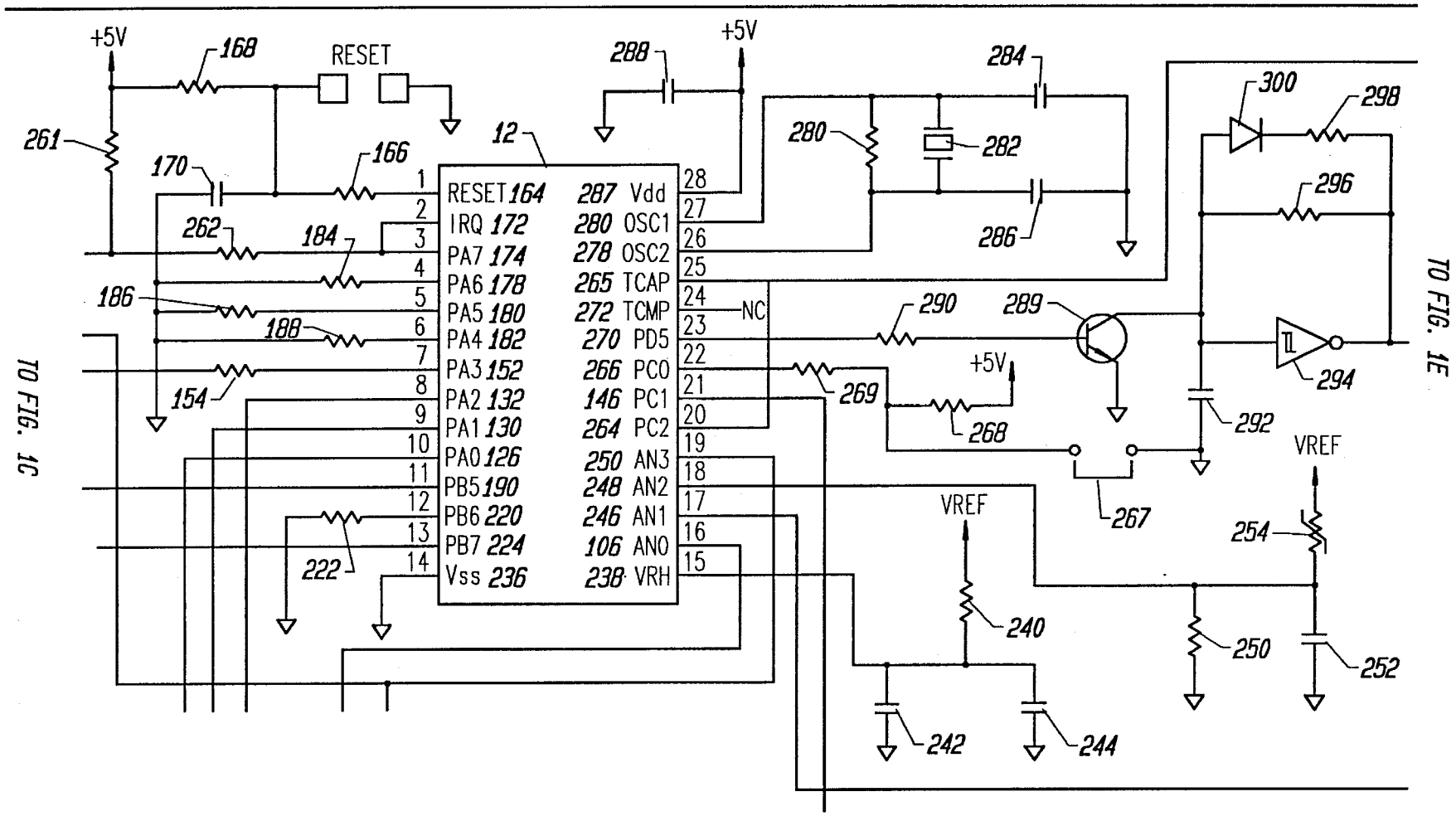

Referring now to FIGS. 1(*a*) through 1(*j*) there is shown a preferred embodiment of an intrusion detection system. The system includes a microcontroller 12 which is available from Motorola under the part number MC68HC05P9. The microcontroller 12 is a 28 pin device that supervises the operation of and the collection of data from the circuits and sensors that are connected thereto and as is further described herein. In further detail, the microcontroller 12 includes a central processor unit, memory mapped input/output registers, an electrically programmable read only memory and a random access memory. In addition, the microcontroller 12 includes twenty bidirectional input/output ports and one input only port, a synchronous serial input/output port, an on-chip oscillator, a timer, and a four channel eight-bit analog-to-digital converter.

A power supply of the system 10 has an input 14 that is connected to an unregulated 8.5–14.2 volt DC power source which is typically external to such systems and located within a control panel (not shown). Power is supplied to the input 14 and is filtered by a capacitor 15. Additionally, the power is filtered by a capacitor 16 to attenuate any AC components, commonly known as "hum," from the supplied power. A suppressor 18 provides over-voltage protection and a diode 20 provides reverse voltage protection. Power at the junction of the capacitor 16 and the diode 20 is provided to an emitter of a PNP transistor 24. Power from the junction of the capacitor 16 and the diode 20 also passes through a resistor 23 and is preregulated by a zener diode 25. This preregulated power is provided to the input of a voltage regulator 22. A resistor 26 is connected between the emitter and base of the transistor 24. A capacitor 27 is connected in parallel with the zener diode 25. An output of the regulator 22 serves as a reference for a pair of voltage regulator circuits. In particular, the output of the regulator 22 is fed through a resistor 28 to the inverting input of an operational amplifier 30. A capacitor 29 is connected between the output and input of the voltage regulator 22. The output of the operational amplifier 30 drives the base of the transistor 24 through a diode 32 and a resistor 34. A collector of the transistor 24 is connected to a voltage output port 36, which in the preferred embodiment of the invention supplies a potential of about 8.1 volts.

The collector of the transistor 24 is also connected to a capacitor 38, which provides further filtering and voltage regulation. In addition, the collector of the transistor 24 is connected to a test point through a resistor 39. The collector of the transistor 24 is also connected to a voltage divider circuit consisting of a resistor 40, a potentiometer 42 and a resistor 44. This voltage divider circuit provides a way of adjusting the potential at the non-inverting input of the operational amplifier 30 to thereby set voltage at the voltage output port 36. A capacitor 45 is connected between common and the noninverting input of the operational amplifier 30. A capacitor 41 and a capacitor 43 each operate to attenuate any AC components that may be present at the non-inverting and inverting input ports of the operational amplifier 30.

The output of the voltage regulator 22 is also fed through a resistor 46 to the non-inverting input of an operational amplifier 48. A capacitor 49 further filters the power provided to the operational amplifier 48. The operational amplifier 48 together with a transistor 50 operate as another voltage regulator to provide a potential of +5 volts that is available at an emitter of the transistor 50 and is used throughout the system 10. In further detail, an output of the operational amplifier 48 is connected through a resistor 52 to the junction of the base of the transistor 50 and a resistor 54. A resistor 56, which is connected to the junction of the emitter of the transistor 50 and the resistor 54, provides a feedback path to an inverting input of the operational amplifier 48. A capacitor 57 provides RFI immunity. A capacitor 58 provides further filtering at a voltage output port 60, and a capacitor 62 operates to provide filtering to the power source for the operational amplifier 48.

In the preferred embodiment of the present invention, an amplifier 64, which amplifies the PIR electrical signal, is partially encased within an RFI shield constructed of tin plated steel materials. The amplifier circuit 64 includes a double element passive infrared detector 66. A set of lenses (not shown), positioned in front of the passive infrared detector 66 determines radiation patterns that can be sensed by the detector 66. A mirror may also be employed to define radiation patterns that can be sensed by the detector 66. The passive infrared detector 66 has a grounded gate with its drain connected to the output voltage port 36 through a resistor 68. A capacitor 69, which is connected between common and the junction of the resistor 68 and the drain of the passive infrared detector 66, operates to provide filtering of RF signals.

The source of the passive infrared detector 66 is connected through a resistor 70 to a non-inverting input of an operational amplifier 72. The resistor 68 operates to block RF from reaching the drain of the passive infrared detector 66. The resistor 70 similarly operates to block RF from the passive infrared detector 66 into the non-inverting input of the operational amplifier 72. A resistor 74 operates as a load resistor for the passive infrared detector 66. A capacitor 76 provides RFI suppression.

An output of the operational amplifier 72 is fed through a coupling capacitor 78 and a resistor 80 to an inverting input of an operational amplifier 82. A capacitor 83 is connected between common and the inverting input of the operational amplifer 72. The values of a resistor 84 and a resistor 92 are selected to set the gain of the operational amplifier 72. Furthermore, a resistor 92 and a capacitor 94 operate with the resistor 84 and a capacitor 86 such that the operational amplifier 72 functions as a band pass filter. The values of the resistor 84 and the capacitor 86 set the low pass corner frequency. The resistor 92 and the capacitor 94 set the high-pass corner frequency. Similarly the operational amplifier 82 operates as a bandpass filter with the lower or high pass corner set by the capacitor 78 and the resistor 80 and the upper or low pass corner set by resistor 88 and the capacitor 90. In the preferred embodiment of the invention, the frequency response of each of these bandpass filters is very similar.

A capacitor 96 operates to provide filtering of the power source connected to the operational amplifier 72. A non-inverting input of the operational amplifier 82 is connected to the output of the regulator 22 through a voltage divider network consisting of a resistor 98, a resistor 100 through a coupling resistor 102. A capacitor 104 provides further filtering from any noise that may be present at the voltage divider network. The resistors 98 and 100 thereby set the DC bias point of an output of the operational amplifier 82. In the preferred embodiment of the invention the DC bias point is +2.5 volts that is approximately in the middle of an analog-to-digital converter input 106 (AN0) of the microcontroller 12.

A resistor 108 couples the output of the operational amplifier 82 to the A-to-D converter of the microcontroller 12 through the input port 106. The resistor 108 also serves to isolate the microcontroller from the power supply used to power the operational amplifier 82. A resistor 109 couples the input port 106 to a test point and provides electrostatic discharge protection and short circuit protection.

In operation, when the passive infrared detector 66 senses a human moving through a volume to be sensed, the signal is amplified by the previously described amplifier, and the signal at the output of the operational amplifier 82 is semi-sinusoidal in form, having a peak amplitude of about ±0.5 to 2.5 volts centered about the bias voltage of 2.5 volts.

A resistor network consisting of a resistor 110 a resistor 112, a resistor 114 and a resistor 116 operate to provide a reference voltage to the non-inverting input of a set of comparators 118, 120 and 122 and to the inverting input of an comparator 124. The comparator 118 has an inverting input connected to a port 126 (PA0) of the microcontroller 12. The potential of this port 126 is normally low, but goes high when a passive infrared event is detected. When the port 126 goes high (+5 volts), the output of the comparator 118 goes low. When the output of the comparator 118 goes low, an LED 128 is energized to thereby indicate a detection of passive infrared radiation. A resistor 129 acts as a current limiting resistor for the LED 128. Similarly, the inverting input of the comparator 120 is connected to an output 130 (PA1) of the microcontroller 112. When a doppler signal is detected by the microwave detector and signal conditioning, as further described herein, the potential of the output port 130 goes high. This causes the output of the comparator 120 to go low causing an LED 130 to be energized to indicate such an event. A resistor 131 acts as a current limiting resistor for the LED 130. In the preferred embodiment of the invention the LED 128 emits green light and the LED 130 emits yellow light.

An inverting input of the comparator 122 is connected to an output port 132 (PA2) of the microcontroller 12. As explained further herein, when an intrusion is detected according to a predetermined pattern, the microcontroller 12 will cause a potential of its output port 132 to go high thereby causing the output of the comparator 122 to go low thereby energizing an alarm LED 134. In the preferred embodiment of the invention the alarm LED 134 emits red light. A resistor 135 acts as a current limiting resistor for the LED 134.

A command input 136 is connected through a resistor 138 to a non-inverting input of the comparator 124. A resistor 140 insures that the non-inverting input of the comparator 124 remains in a high state until the command input 136 is shorted to common. A pair of diodes 142 and 144 are normally reverse biased to thereby provide electrostatic discharge protection and over voltage protection.

In operation, when the command input 136 is shorted to common, the non-inverting input of the comparator 124 goes low causing its output to go low thereby forcing an input 146 (PC1) of the microcontroller 12 to also go low. Such shorting of the command input 136 provides a self-test sequence for each of the sensor circuits of the system 10. The non-inverting input of the comparator 124 is also connected through a capacitor 148 to common. This capacitor 148 acts to attenuate any RF signals present at said inverting input. A capacitor 150 similarly acts as a filter for the power supplied to the comparator 124. A resistor 151 provides the pull up for the junction of the output of comparator 124 and the microcontroller input 146. A capacitor 153 provides bypass filtering at a power input port of the comparator 118.

An output 152 of the microcontroller 12, through a resistor 154, drives a base of a transistor 156. A resistor 157 couples the collector of a transistor 156 to a trouble terminal 158. A suppressor 159, connected between the collector of the transistor 156 and common, suppresses undesired transients to the trouble terminal port 158. In normal operation the transistor 156 is not conductive and may operate in parallel with an external normally open tamper switch that senses the removal of an external cover of the system 10.

The trouble terminal port 158 may be externally connected to a terminal 160 of the tamper switch 162. If a cover of the system 10 were removed, the tamper switch 162 which is normally open would close thereby shorting terminal 160 to common. This condition may be displayed by an external display within a control panel to indicate problems with the system 10. Alternatively, if the microcontroller 12 for some reason determined the existence of a problem, the port 152 of the microcontroller 12 would go high causing the port 158 to be conductive to common.

The trouble terminal 158 functions as a trouble output, going low if either a self test error is detected or if an error is encountered because of a "fault condition." A "fault condition" can occur because of a failure of a sensor or its associated subsystem. Another source of failure which would cause a fault condition is improper alignment of sensors, since sensors, in a multiple technology system, must detect the presence of an intrusion in the same space or proximate location. Yet another source of failure which would cause a fault condition is tampering, typically by a would-be intruder. For example, such a would-be intruder might mask or intentionally disable a sensor subsystem. U.S. Pat. No. 4,710,750. FAULT DETECTING INTRUSION DETECTION DEVICE, issued Dec. 1, 1987, assigned to the assignee of the present invention, discloses and explains the detection of such fault conditions, and said patent is incorporated herein by reference.

Referring now in further detail to the microcontroller 12, a reset port 164 ($\overline{\text{RESET}}$) is connected through a resistor 166 to an RC circuit consisting of a resistor 168 and a capacitor 170. When the system 10 is first powered, the resistor 168 and capacitor 170 ensure that the reset terminal 164 is held at a sufficiently low potential to hold the microcontroller 12 in reset until power is up. An external interrupt port 172 ($\overline{\text{IRQ}}$) is connected to a port 174 (PA7). The port 174 can function as either an input or output port. In the preferred embodiment of the invention the port 174 remains as an input. After power up, the port 174 driven by the output of the comparator 176. A port 178 (PA6), a port 180 (PA5) and a port 182 (PA4) are each connected through a resistor 184, 186 and resistor 188, respectively, to common. These ports are not utilized in the preferred embodiment of the invention. However, to prevent excessive current and potential latch up from floating inputs, it is preferable to terminate such unused ports. Additionally, in the unlikely event of a potential charge on common, the resistors 184, 186 and 188 provide current limiting.

As previously described, the port 152 (PA3) drives up the base of the transistor 156 thereby causing the transistor 156 to become conductive. Also as previously described, the ports 132 (PA2), 130 (PA1) and 126 (PA0) drive the inverting inputs of the comparators 122, 120 and 118 respectively.

An alarm output 190 (PB5), through a resistor 192, drives the base of a switching transistor 194. When the signal at the port 190 goes high, the transistor 194 conducts and thereby causes current to flow from a transistor 196 through a diode 197 and through a field coil 198 of a relay 200, thereby closing a set of contacts 202 of the relay 200. The relay 200 is normally energized (no alarm). When the contacts 202 open, this condition indicates an alarm.

A pair of resistors 204 and 206 and a zener diode 208 operate to set the limit of potential at the base of the transistor 196. When the contacts 202 are closed, an alarm signal path is provided at a pair of outputs 210 and 212. This signal path may, if desired, be used to energize a siren, horns, lights or any other electrical device that is reasonably expected to gain the attention of an attendant.

A diode 214 operates to limit the voltage developed across the field coil 198 when the coil 198 is de-energized. A pair of varistors 216 and 218 are each connected to one side of the contacts 202 to thereby limit transients which may be coupled to the contacts 202.

A port 220 (PB6) is unused and is terminated to common through a resistor 222. A port 224 (PB7) selectively drives the passive infrared detector 66 through a transistor 226. In further detail, the port 224, through a resistor 228, drives the base of the transistor 226. A capacitor 230 provides filtering, while a resistor 232 terminates the port 224 to common on power up. When the base of the transistor 226 is driven high, the transistor 226 becomes conductive thereby providing a path to common for the voltage divider that consists of the resistor 68 and a resistor 234 to common.

A ground pin 236 (VSS) of the microcontroller 12 is connected to common.

A port 238 (VRH) is used to provide a 5 volt reference potential to the analog-to-digital converter within the microcontroller 12. A resistor 240 and a pair of capacitors 242 and 244 provide filtering of the 5 volt reference supply.

The ports 106 (AN0), 246 (AN1), 248 (AN2) and 250 (AN3) provide the input of a four channel multiplexer contained within the microcontroller 12. The processor 12, through firmware (detailed further herein), selects to which channel the A-to-D converter of the microcontroller 12 will be connected. In further detail, the port 106 is connected to and dedicated to the passive infrared detection module 64. The port 246 is connected to and dedicated to the microwave test node. Port 248 is connected to and dedicated to a thermistor test node.

Referring again to the port 248, the port 248 is connected to the junction of a resistor 250 a capacitor 252 and a thermistor 254. This circuit functions to provide temperature compensation information (fox passive infrared detection) to the microcontroller 12. In operation the microcontroller is programmed to read the input port 248, in response to that reading which is indicative of temperature, the microcontroller 12 adjusts its internal comparator set points for the passive infrared radiation detector 64.

A port 250 of the microcontroller 12 is an A-to-D input which reads the reference voltage from the junction of the resistor 116 and the non-inverting input of the comparator 176. The comparator 176 has its inverting input connected through a resistor 256 and a resistor 58 to the power supply port 60 and to the output of a comparator 260. The output of the comparator 176 is connected to the junction of a resistor 261 and a resistor 262. The resistor 262 couples the output of the comparator 176 to the inputs 172 ($\overline{IRQ}$) and 174 (PA7) of the microcontroller 12.

In operation the comparator 260 toggles every time a microwave pulse is detected. This keeps the inverting input of the comparator 176 below the threshold provided to its non-inverting input. If the microwave pulses stop, the inverting input of the comparator 176 goes high causing the output of the comparator 176 to go low, thereby indicating a "no microwave" self test error.

A port 264 (PC2) is connected directly to a port 265 (TACP). These ports are used by the microcontroller 12 to determine microwave events. A port 266 (PC0), is used as an input port for a user invoked self test that is actuated by shorting with a jumper 267. In contrast to a signal provided at the command input 136, if a stored error code exists, but the error codes are no longer displayed, a user invoked self test will initiate a display of the error codes and provide service personnel a recent history of any system faults. In normal operation +5 volts is applied to the port 266 through a resistor 268 and a resistor 269. When the jumper 267 is shorted to common, the port 266 goes low, thereby initiating a self test sequence.

A port 270 (PD5) could be used to disable an oscillator of the microwave transmitter as further described herein, however, in the preferred embodiment of the invention, the port 270 does not provide this function. The port 272 (TCMP) is unused. The port 266 (TCAP) is utilized to provide an external interrupt and is configured to be negative edge or falling edge triggered. When a falling edge occurs, such an edge interrupts the microcontroller 12 and provides an indication that a microwave event (a doppler signal) has occurred. Microwave event processing of the present invention is interrupt driven, and because it is only edge sensitive it is necessary to sense the output of the microwave circuitry through the port 264 (PC2).

A port 276 (OSC1) and a port 278 (0SC2) are connected to a resistor 280 a quartz crystal 282 and a pair of capacitors 284 and 286. The quartz crystal 282 is selected to operate the clock of the microcontroller 12 at a frequency of 4 megahertz. A port 287 of the microcontroller 12 is connected to the output port 60 the power supply. Bypass filtering at the port 287 is provided by a capacitor 288.

The base of a transistor 289 is connected through a resistor 290 to the port 270. The collector of the transistor 28 is connected to the junction of a capacitor 292 and the input of a Schmidt trigger 294. The Schmidt trigger 294 utilizes a feedback path consisting of a resistor 296, a resistor 298 and a diode 300 to provide an oscillation period of 500 microseconds having a pulse width of 10 microseconds.

The signal oscillates at or about 2 kilohertz and the pulse is about 10 microseconds in duration. The output of the Schmidt trigger 294 is fed both to the input of a Schmidt trigger 302 and also through a diode 304 and a resistor 306 to the input of a Schmidt trigger 308. The diode 304, the resistor 306 and a capacitor 310 operate to delay the transition of the output of the Schmidt trigger 294 to the Schmidt trigger 308. The output of the Schmidt trigger 302 is fed to the input of each a Schmidt trigger 312 a Schmidt trigger 314 and a Schmidt trigger 316. A diode 317 a resistor 318, a capacitor 319 operate to delay the edges of the signal at the output of the Schmidt trigger 302. This configuration is related to achieving proper sampling waveforms of the detector with respect to the transmitter.

The output of the Schmidt triggers 312, 314 and 316 are paralleled into a capacitor 320, a resistor 321 and a capacitor 322. A junction of the capacitor 320 and the resistor 321 is fed to the base of a transistor 324. The collector of the transistor 324 provides a substantially square pulse to a Gunn diode (as explained further herein with reference to FIG. 2) through a terminal 326.

Figure 2:
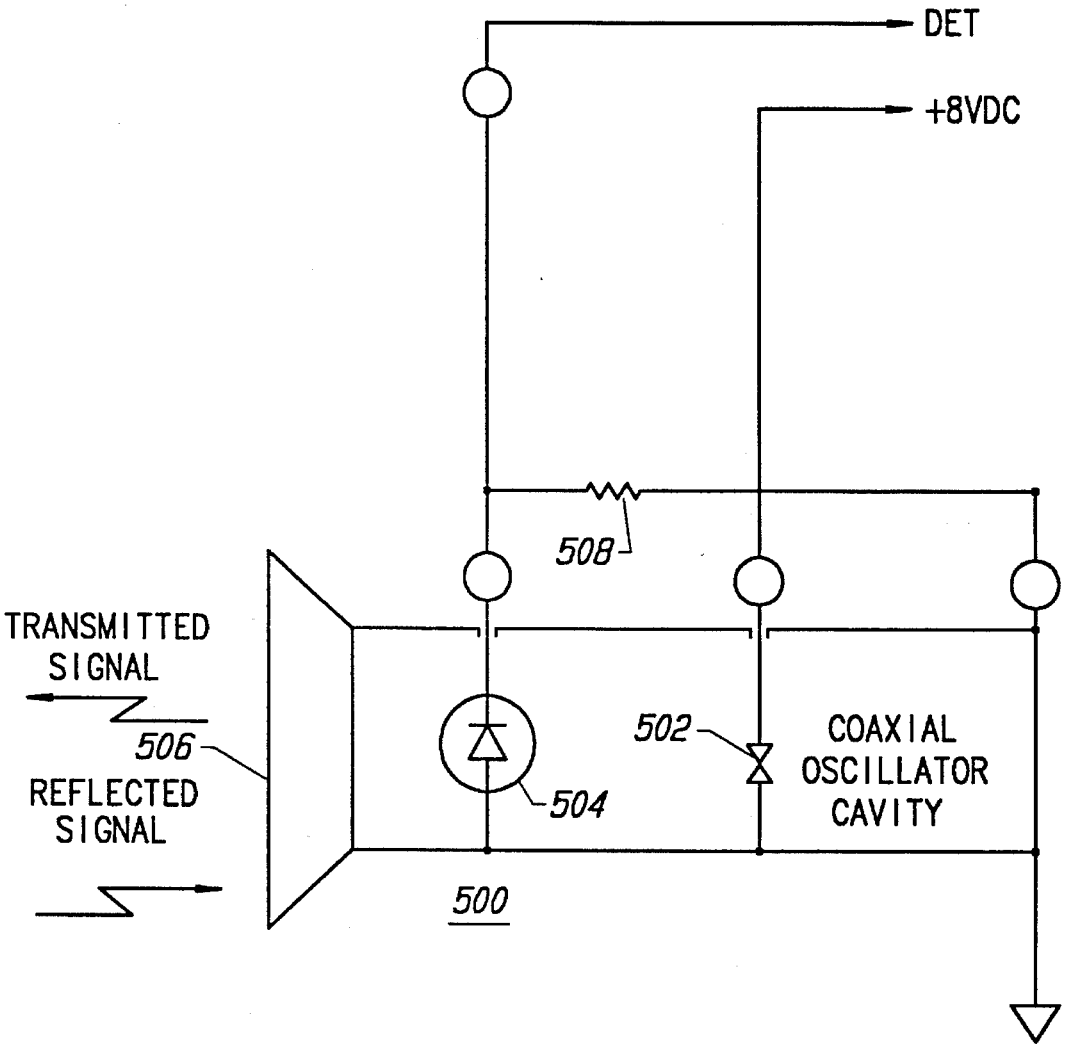
FIG. 2 is a detailed schematic diagram of a microwave transceiver that is utilized in conjunction with the intrusion detection system of FIG. 1.

With reference now to FIG. 2, a microwave transceiver 500 is shown. The microwave transceiver includes a Gunn diode 502, which when provided with DC power oscillates with a nominal power output of 8 milliwatt. The transceiver also includes a Schottky mixer diode 504 which is mounted inside a waveguide/antenna 506. The transceiver 500 also includes a resistor 508.

Figure 1E:
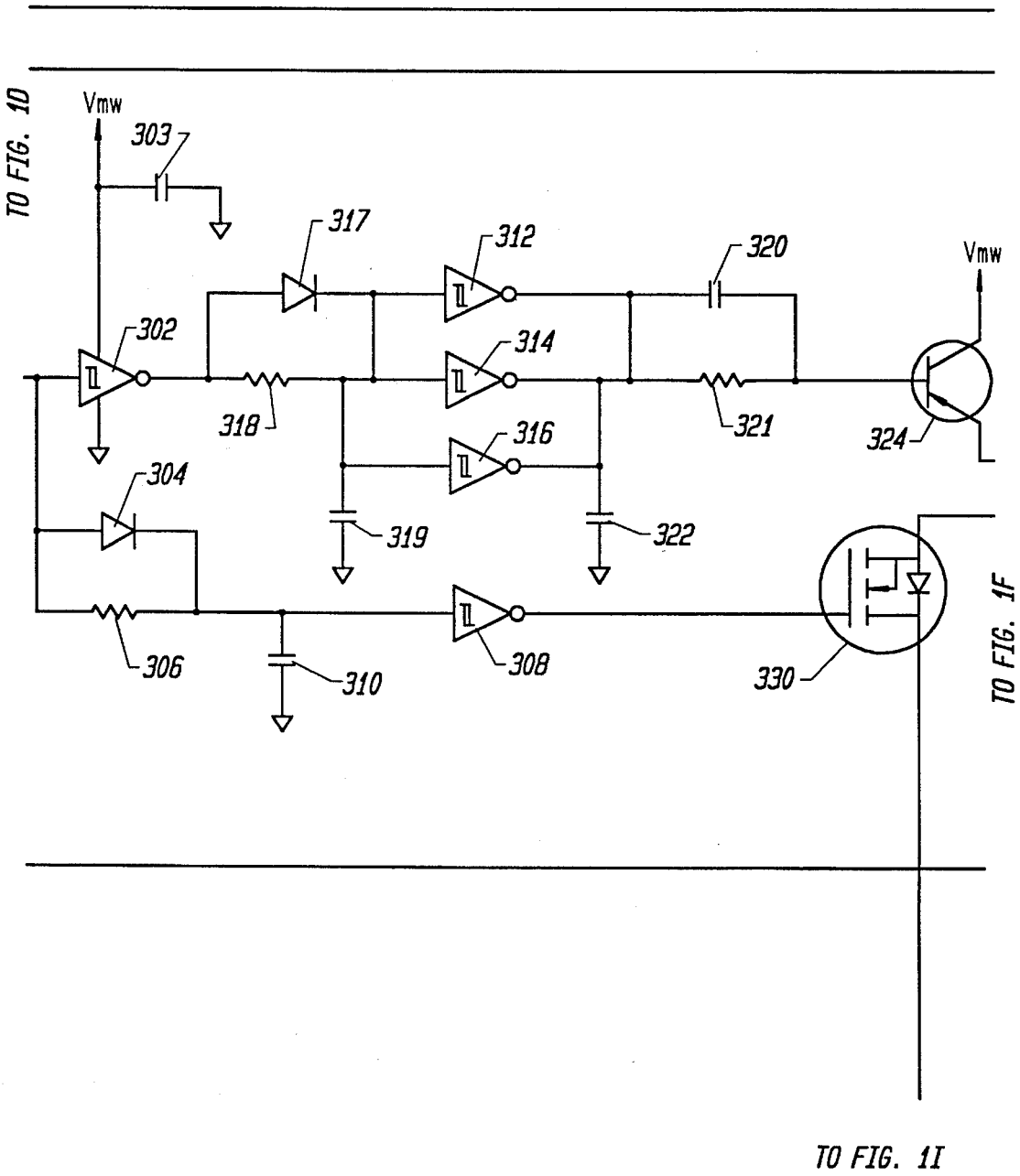
Figure 1F:
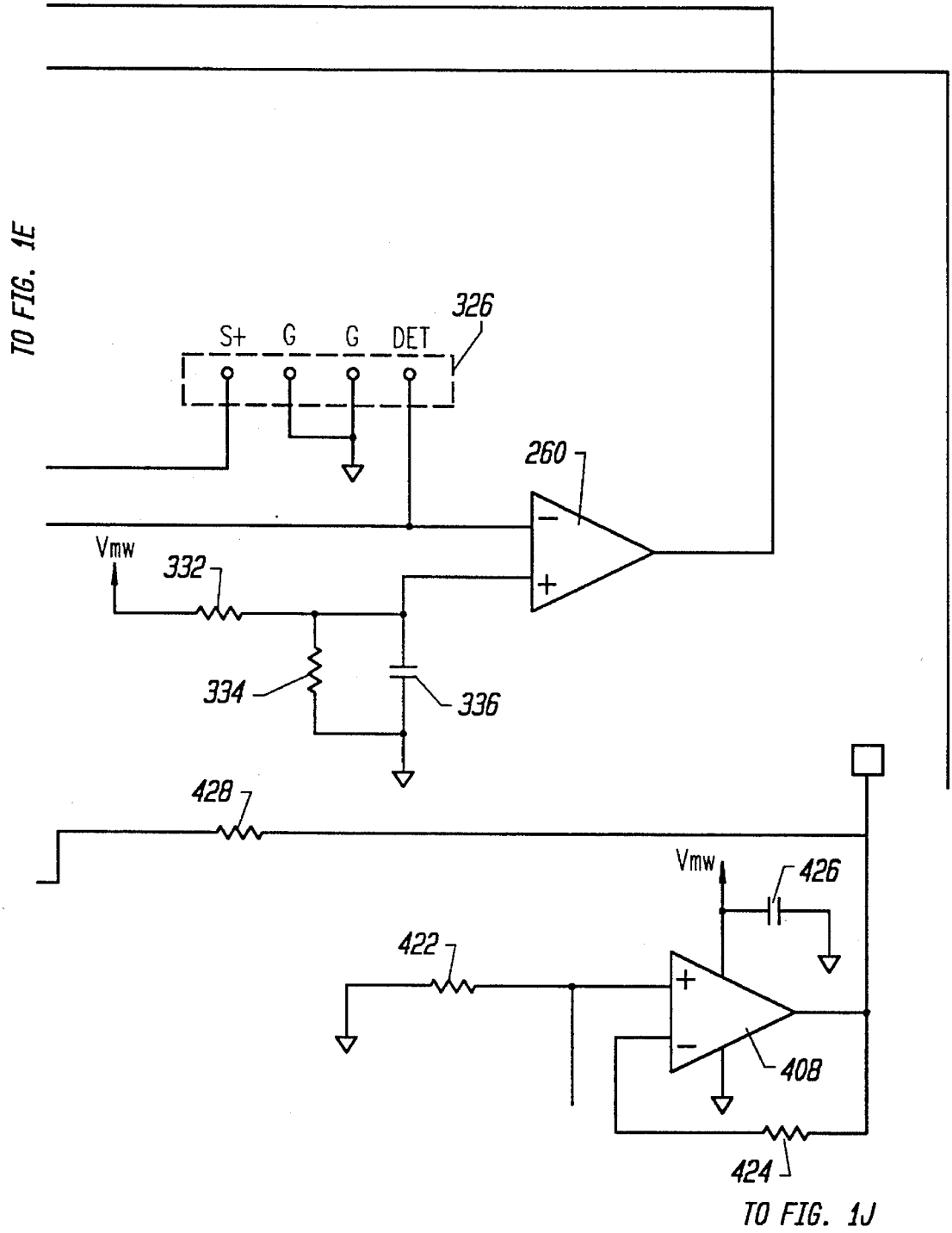
Figure 1G:
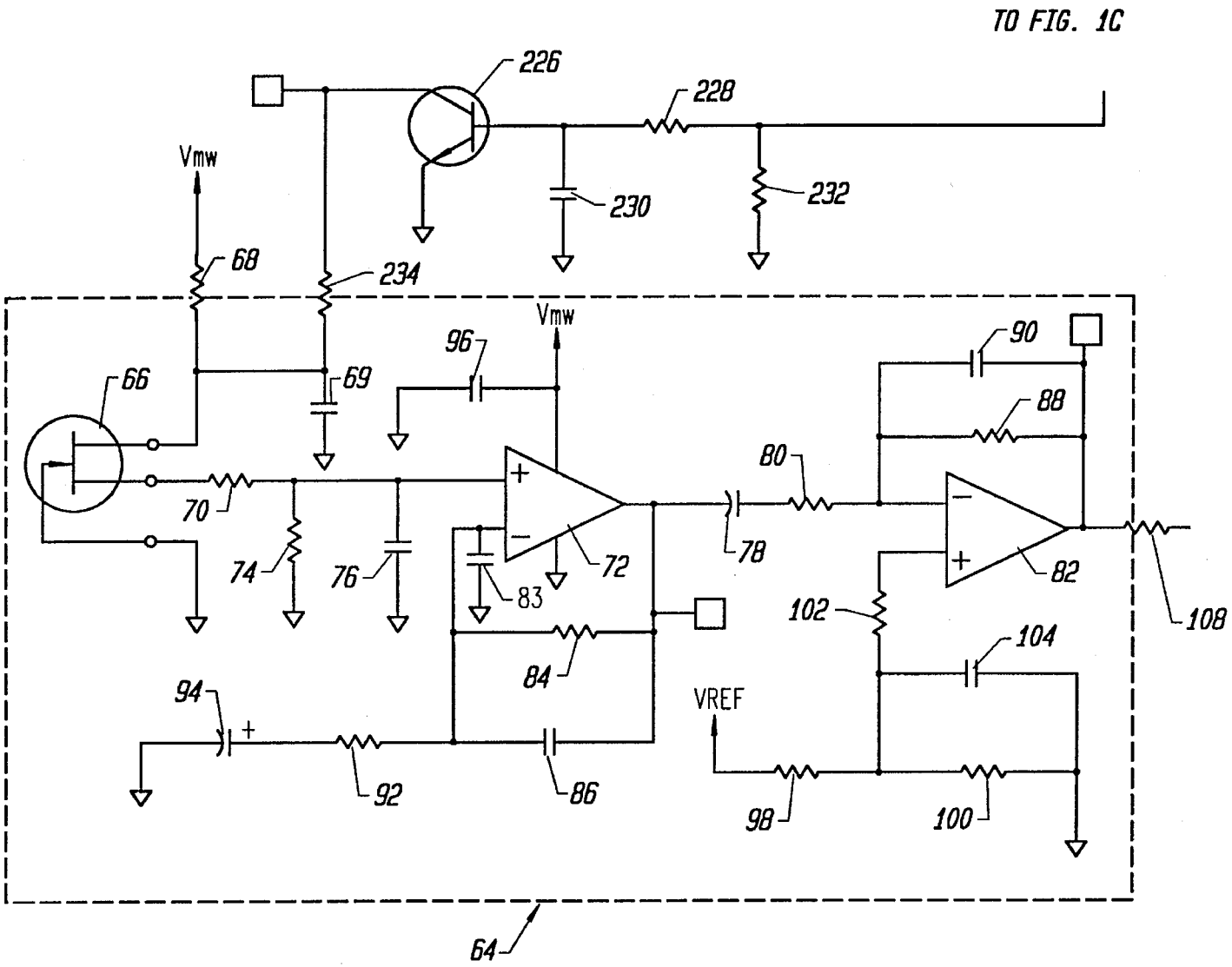
Figure 1H:
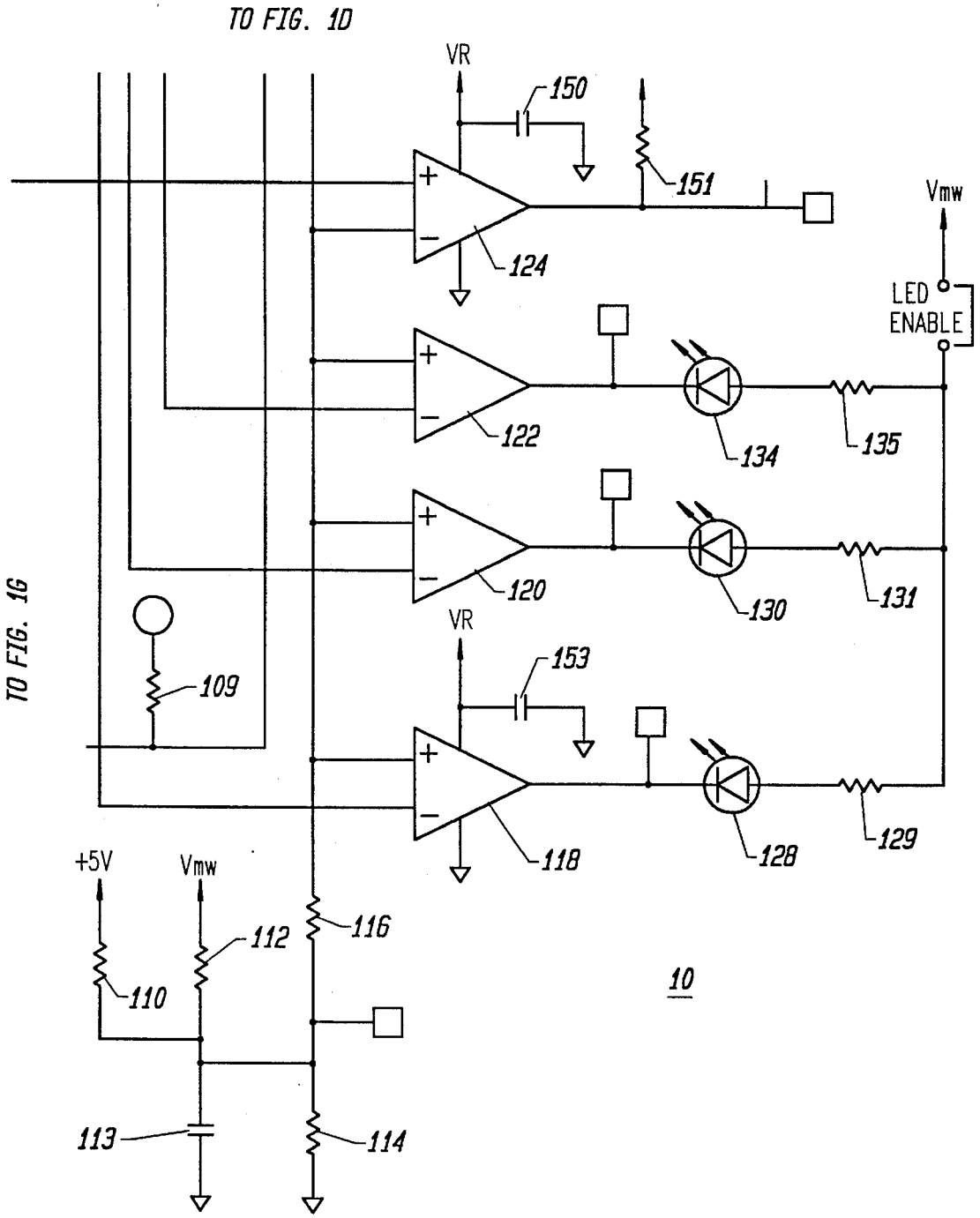
Figure 1I:
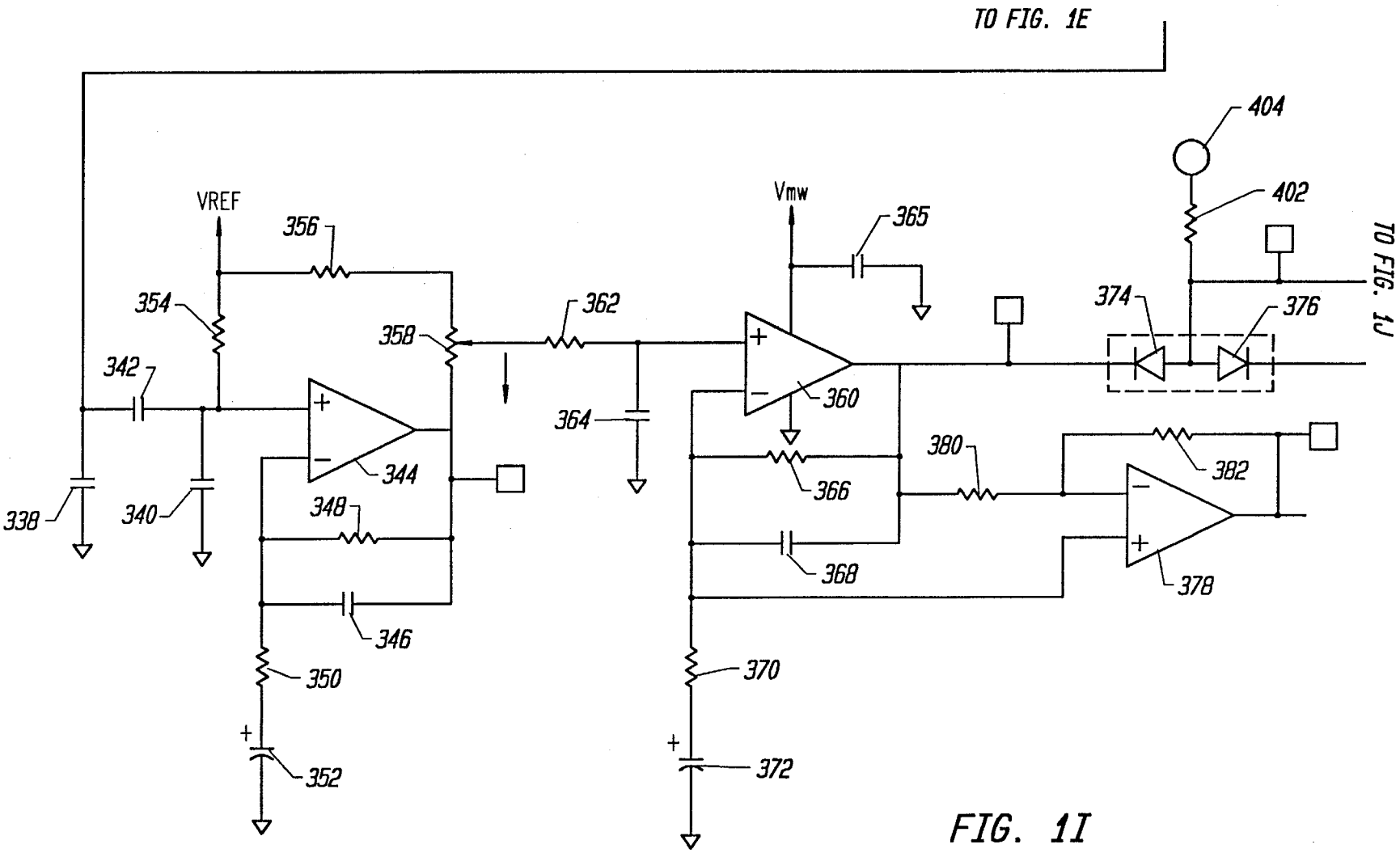
Figure 1J:
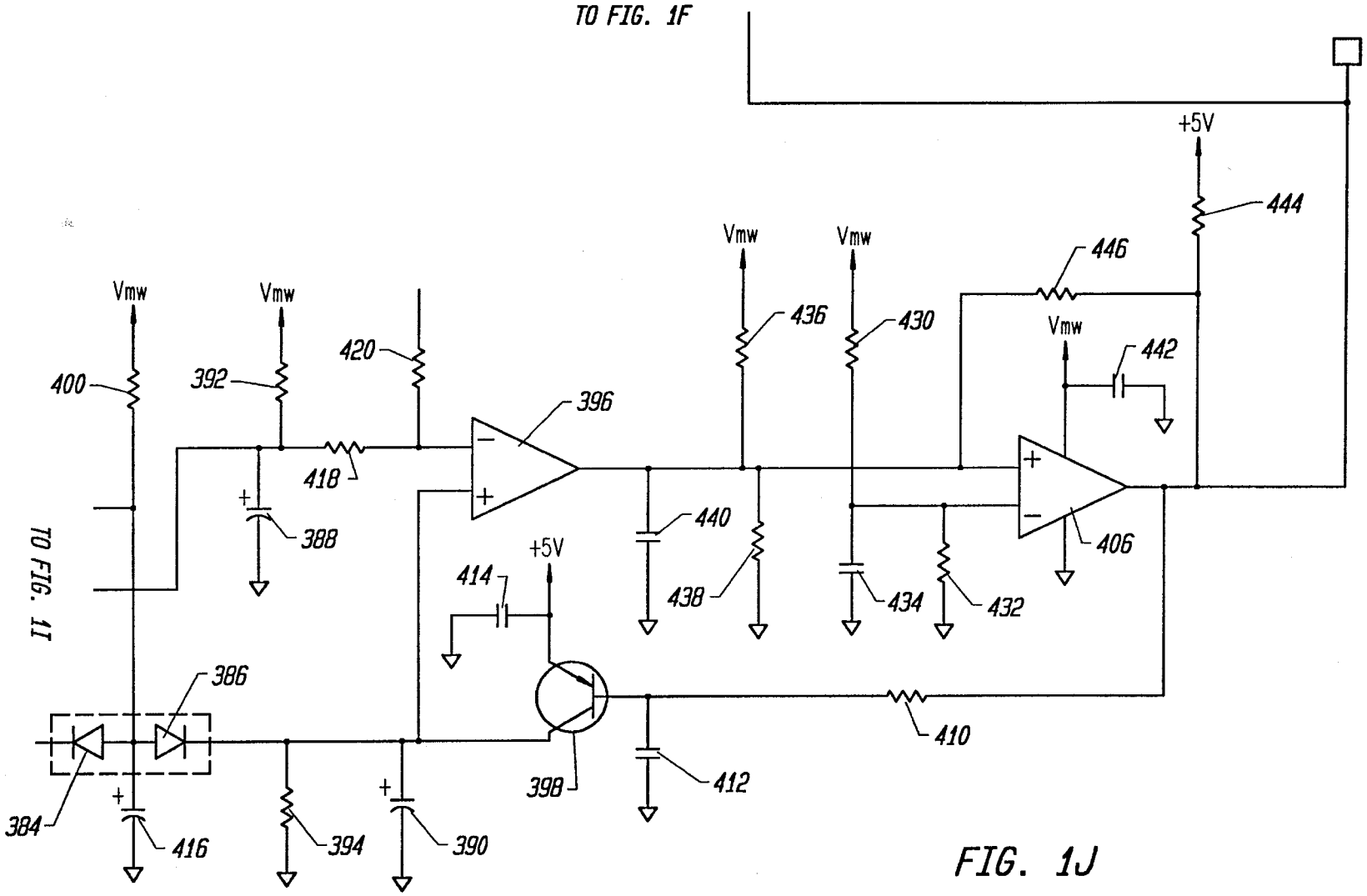

Referring now to both FIGS. 1 and 2, in operation the collector of transistor 324 FIG. 1E provides a relatively square pulse to the Gunn diode 502. The Gunn diode 502 thereby generates microwave frequency signal in a range between 9 to 11 gigahertz, depending upon the amplitude of the pulse. The microwave frequency signal is propagated by the antenna 506. Reflected microwave energy is collected by the antenna 506 and provided to the Schottky mixer diode 504. The mixer diode 504 mixes the microwave signal from the Gunn diode 502 with the reflected signal to produce a signal with a certain phase. As a person moves within the sensed volume of space, the phase changes, thereby creating the doppler signal. This signal is provided to the inverting input of the comparator 260 and to a sampling field effect transistor 330. The non-inverting input of the comparator 260 is connected to a voltage divider network consisting of a resistor 332, a resistor 334 and a capacitor 336. This voltage divider network sets the threshold of the comparator 260. The capacitor 336 is a bypass capacitor.

The output of an operational amplifier 360 provides a relatively low frequency signal representative of doppler shift resulting from movement of an object within a space which is monitored. The doppler signal has a frequency generally between 5 and 70 Hertz.

Referring again to FIG. 1, the output of the Schmidt trigger 294 is fed to the input of the Schmidt trigger 309 through the shaping network consisting of the diode 304 the resistor 306 and the capacitor 310. The output of the Schmidt trigger 308 is fed to the gate of a sampling field effect transistor 330.

In operation the sampling field effect transistor 330 samples the pulse from the Schottky mixer diode 504 only during the period that the pulse is fed to the sampling field effect transistor from the Schmidt trigger 308. Stated differently, the sampling field effect transistor 330 begins sampling at the leading edge of the pulse from the Schmidt trigger 308 and stops sampling at the falling edge of the pulse from the Schmidt trigger 308.

The output of the sampling field effect transistor 330 is fed through a filter consisting of a capacitor 338, a capacitor 340 and a capacitor 342 to the non-inverting input of an operational amplifier 344. A capacitor 346, a resistor 348, a resistor 350 and a capacitor 352 together enable the operational amplifier 344 to function as a bandpass filter. A resistor 354 provides a bias to the non-inverting input of the operational amplifier 344 while a resistor 356 and a potentiometer 358 provide a bias to the output of the operational amplifier 344.

The center arm of the potentiometer 358 is connected to the non-inverting input of an operational amplifier 360 through a resistor 362. A capacitor 364 is connected between the non-inverting input of the operational amplifier 360 and common. Power is provided to the operational amplifier 360 from the power output port 36, and such power is filtered with a bypass capacitor 365.

A resistor 366, a capacitor 368, a resistor 370 and a capacitor 372 operate to enable the operational amplifier 360 to function as a bandpass filter. The output of the operational amplifier 360 is fed to a pair of back-to-back diodes 374 and 376 and also to the inverting input of an operational amplifier 378 through a resistor 380. A resistor 382 sets the gain of the operational amplifier 378. The output of the operational amplifier 378 is fed to a pair of back-to-back diodes 384 and 386. These diodes 384 and 386 conduct during the negative portion of a waveform. Similarly, the diodes 374 and 376 conduct during the negative part of a waveform such that as diode 374 pulls low it turns off diode 376. At this point a pair of time constants set by a capacitor 388 and a capacitor 390, in conjunction with a resistor 418, a resistor 420 and a resistor 422, begin to decay, and cross over a point at which comparator 396 flips and provides a low output. The arrangement of the transistor 398 and the comparators 396 and a comparator 406 provides a hysterisis effect. In operation, when the output of the comparator 396 goes low, this causes the output of the comparator 406 to go low.

This turns on the transistor 398 which causes the non-inverting input of the comparator 396 to go high, which in turn causes the output of the comparator 396 to return to high.

A resistor 400 operates to set a bias point for the diodes 374 and 376 and contributes to a time constant with a capacitor 416. Only a continuing doppler signal will cause the potential of non-inverting input of the comparator 396 to begin to decay again. Hence, any noise will not cause false microwave events because the hysteresis opens the threshold back up. A resistor 402 couples the junction of the diodes 374 and 376 to a test point 404.

The operational amplifier 378 forms part of an absolute value circuit, providing fullwave rectification to the negative peak detecting floating threshold circuit connected to the comparator 396. The comparator 396 provides a pulse out of the microcontroller 12 and provides immunity to noise.

As the signal provided to the inverting input of the comparator 396 decays, the output of the comparator 396 flips and goes low and is then translated by a comparator 406 whose output is fed to input 266 of the microcontroller 12. Additionally, an operational amplifier 408 samples the signal at the inverting input of the comparator 396 and provides an output operative to determine whether the signal at the inverting input of the comparator 396 is within a certain tolerance. This within tolerance confirmation signal is provided to the input port 246 of the microcontroller 12.

Referring again to the comparator 406, the output of the comparator 406 is provided to a feedback path consisting of a resistor 410, a filter capacitor 412, and the transistor 398. The collector of the transistor 398 is connected to the non-inverting input of the comparator 396. A capacitor 414 provides bypass filtering at the emitter of the transistor 398. The capacitor 416 operates together with the resistor 400 to provide filtering of signals from the output of the operational amplifiers 378 and 360. The resistor 418 couples the diode 376 to both the inverting input of the operational amplifier 396 and, through a voltage divider consisting of the resistor 420 and a resistor 422, to the non-inverting input of the comparator 408. A resistor 424 is used to balance the bias current of the operational amplifier 408. A bypass capacitor 426 provides filtering of power supplied to the operational amplifier 408. A resistor 428 couples the output of the operational amplifier 408 to the port 246 of the microcontroller 12.

A voltage divider consisting of a resistor 430 and a resistor 432 sets the bias at the inverting input of the comparator 406. A capacitor 434 provides filtering at the inverting input of the comparator 406. A capacitor 440 together with the resistors 436 and 438 provide an RC delay. A capacitor 442 provides bypass filtering at the power input port of the comparator 406. A resistor 444 operates as a pull up resistor at the output of the comparator 406. A resistor 446 provides a positive feedback hysteresis to the non-inverting input of the comparator 406. Stated differently, the resistor 446, as a function of the output of the comparator 406, shifts the bias point of non-inverting input of the comparator 406.

Figure 3A:
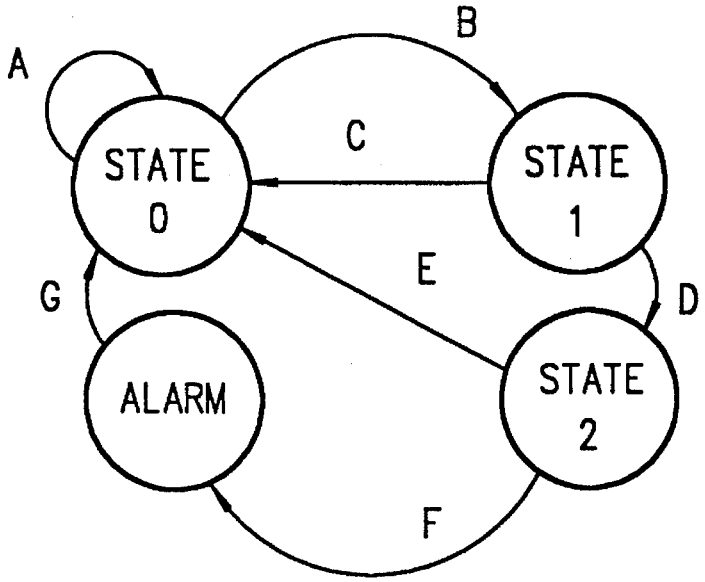
FIGS. 3(*a*) and 3(*b*) are detailed charts showing the possible states of the intrusion detection system of FIG. 1.

Referring now to FIG. 3A there is shown a state diagram that visually illustrates an alarm processing sequence of the preferred embodiment of the invention. In particular, when the passive infrared circuitry senses an intrusion within a given volume of space this intrusion is called a "passive infrared event." Similarly when the microwave circuitry of the system 10 senses an intrusion within a given volume, this is called a "microwave event." In the preferred embodiment of the invention, the system 10 is initially in state 0. If either a microwave event or a passive infrared event occurs and is followed by the other event separated by a time period greater than 4 seconds, the system 10 remains in state 0. When a microwave event or a passive infrared event occurs, and is followed by the other event within a period of less than 4 seconds, the system 10 enters state 1.

While in state 1, if there is no occurrence of a passive infrared event of the same polarity within 15 seconds of the commencement of state 1, the system 10 returns to state 0. If a passive infrared event occurs within 15 seconds while the system 10 is in state 1, the system 10 advances to state 2. While in state 2, if no microwave event occurs within 4 seconds of the commencement of state 2, the system 10 returns to state 0. However, if a microwave event occurs within 4 seconds of the commencement of state 2, then an alarm signal is generated. In the preferred embodiment of the invention, the alarm signal has a duration of 5 seconds after which the system 10 reverts to state 0. Whenever the system 10 is in state 0, the entire alarm processing sequence can be repeated.

In summary an alarm is generated only by the occurrence of the following sequence of events:

1. Either a microwave event or a passive infrared event occurs and is followed by the other event within four seconds; and
2. Thereafter, a passive infrared event of the same polarity occurs within fifteen seconds; and
3. Thereafter, a microwave event occurs within four seconds.

Thus a total of four detection events (two passive infrared events and two microwave events) within prescribed time periods must occur before an alarm signal is generated. The requirement of numerous events being detected before an alarm signal is generated can be seen with reference to the condition if one of the sensors and its circuit malfunctions.

Figure 3B:
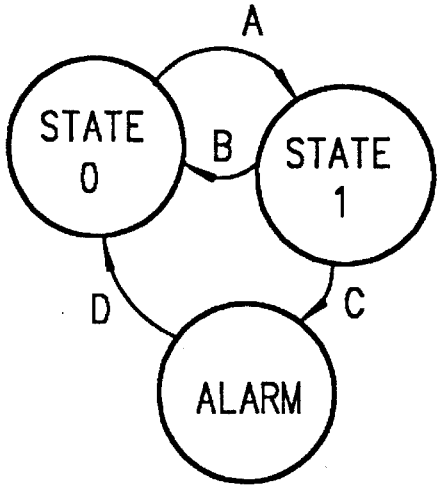

Referring now to FIG. 3B, in the event either the passive infrared portion of the system 10 or the microwave portion of the system 10 malfunctions, the system 10 enters a single technology mode that is illustrated by FIG. 3B. While in this mode the system 10 relies upon the sensing technology that is still operational. Initially, the system 10 is in state 0. If the operational technology detects the occurrence of an event, the system 10 moves from state 0 to state 1. Such an initial detection need not occur within any predetermined period. If the operational technology does not then detect an event within 4 seconds of the commencement of state 1, the system 10 reverts to state 0. If however, the operational technology detects an event within 4 seconds of the commencement of state 1, the system 10 generates an alarm signal. The alarm signal has a duration of 5 seconds, after which the system 10 returns to state 0. At that point the system 10 reverts to state 0, and is ready to repeat this alarm processing sequence.

As can be seen, in the event one of the sensor subsystems malfunctions, the remaining operative subsystem would not trigger an alarm signal based upon the detection of a single event. The remaining operational sensor generates an alarm signal if two detections occur within a predetermined time period. Although in the preferred embodiment of the invention this predetermined time period is also four seconds as is the first time period used when both sensor systems are operative, the predetermined time period for this back-up mode of operation may be a different length, for example, seven seconds. In addition, different length predetermined time periods may be utilized when both the passive infrared and microwave portions of the system 10 are operative.

Figure 4:
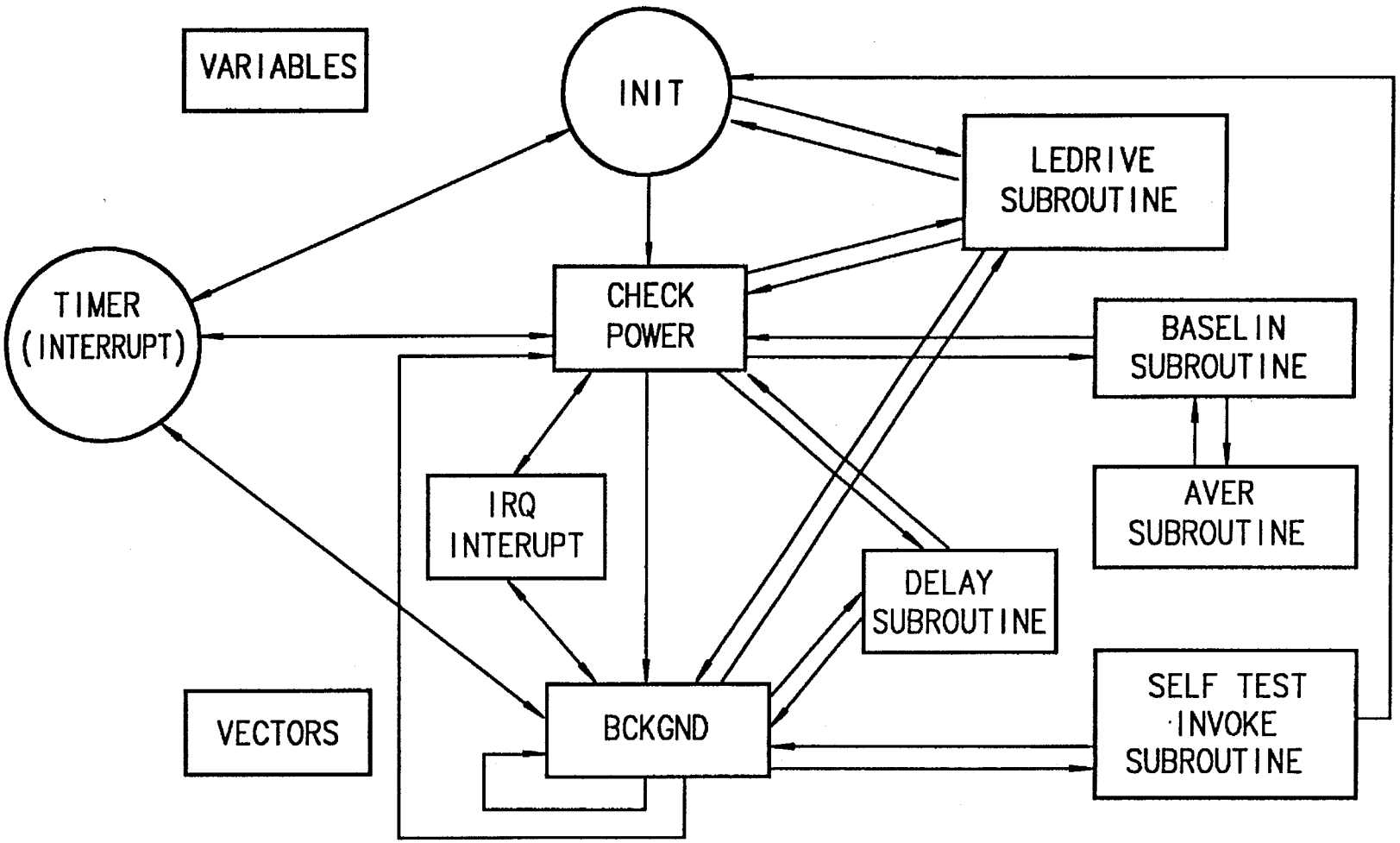
FIG. 4 is a block diagram illustrating the relationship of each software module.

FIG. 4 illustrates various modules of the computer program utilized in the preferred embodiment of the invention and how each of the modules relate to the others. "Variables" are stored in RAM within the microcontroller 12 and are available to these modules. "Vectors" contains addresses of interrupt routines and the start address of the program (Init) which is initiated on a Reset. As detailed in the source code listing below, the alarm algorithm is contained within the background (BCKGND) module. INIT refers to initialization, BASELN refers to the baseline subroutine and AVER refers to the averaging subroutine.

The following is a source code listing of the computer program for the microcontroller 12 in accordance with the preferred embodiment of the invention:

Copyright ©1993 C&K Systems, Inc.

```
*****************************************************
*     This module contains all port register and RAM *
*     equates also it contains the look up table for *
*     the LED codes                                  *
*                                                    *
*****************************************************

VARS:

      XDEF PORTA,PORTB,PORTC,PORTD,DDRA,DDRB
      XDEF DDRC,DDRD,SCR,TCR,PROG,ADSCR,ADDR,MOR,COP
      XDEF TESTYP,LEDS,FLASH,TESTNM,ANSWLO,ANSWHI
```

```
        XDEF AVEHIGH,AVELOW,AVECNTH,AVECNTLI,INTERH,INTERL
        XDEF INTCNT,STPTLO,STPTHI,TSTAT,TTIME,UPIR1,UPIR2
        XDEF LPIR1 ,LPIR2,PPNUM,AVECNT,FLSHTM,TSRTCNTH,TCNTL
        XDEF ATCNTH,ATCNTL,ICRH,ICRL,OCRH,OCRL,RESCTL,RESCTH
        XDEF UWAVE,ALRMCT,STATE,STIML,STIMH,POLAR,POSTHS
        XDEF ATIMER,NEGTHS,PIRCNT,UWAVNF,UWAVC,PIRHIC,PIRLOC
        XDEF STACNT,STA2C,ERCODE,FAIL1,STIMM,RES8,PIRBCT
        XDEF TMPTIM,TTIML,TTIMH,NEGINF,DELTIM,DELTA,TROUB
        XDEF TRBSTA

PORTA       EQU   $0000
PORTB       EQU   $0001
PORTC       EQU   $0002
PORTD       EQU   $0003

DDRA        EQU   $0004
DDRB        EQU   $0005
DDRC        EQU   $0006
DDRD        EQU   $0007

SCR         EQU   $000A
TCR         EQU   $0012
TSR         EQU   $0013
ICRH        EQU   $0014
ICRL        EQU   $0015
OCRH        EQU   $0016
OCRL        EQU   $0017
TCNTH       EQU   $0018
TCNTL       EQU   $0019
ATCNTH      EQU   $001A
ATCNTL      EQU   $001B

PROG        EQU   $001C
ADDR        EQU   $001D
ADSCR       EQU   $001E

MOR         EQU   $0900
COP         EQU   $1FF0

TESTYP      EQU   $0080       * Self Test Type
                        * B7 1 = PU/UI, 0 = On Going
                        * B6 1 = Toggle A Relay, 0 Don't
                        * B5 1 = Display On Going ST Code
                        * B3 1 = Temp Comp Failure
                        * B2 1 = On Going Failure PS
                        * B1 1 = Single Tec uWave
                        * B0 1 = Single Tec PIR

LEDS        EQU    $0081
FLASH       EQU    $0082      * Toggle byte with LEDs
TTIME       EQU    $0083      * Time Var for Pu Self Test
FLSHTM      EQU    $0084      * Toggle Rate of LEDs
```

```
ATIMER      EQU    $0085      * Alarm Timer Flag
                         * B0 = uWave Timer
                         * B1 = PIR Upper Timer
                         * B2 = PIR Lower Timer
                         * B3 = State 1 Timer
                         * B4 = State 2 Timer
                         * B7 = Alarm Timer
STATE       EQU    $0086      * B7 = 1 Alarm, B6 = 1 RES
                         * B5 = On Going ST Time

                         * B4 = Pending alarm State 2
                         * B3 = Pending alarm State 1
                         * B2 = Out of threshold
                         * B1 1 = Trouble uWave
                         * B0 1 = Trouble PIR
TSTAT       EQU    $0087      * Test Status Byte B7=1 Fail
                         * B5 = 1 PIR Set Point Fail
                         * B4 = 1 Temp Comp Fail
                         * B2 = 1 STPuW,B3 = 1 STPPIR
                         * B0 = 1 STBuW, B1 = 1 STBPIR
ERCODE      EQU    $0088      * Eight bit error code
                         * $20 - $2F address to LED/flash
                         * codes
FAIL1       EQU    $0089      * SUSPECT MODE SAME AS ABOVE
                         * 7 = Power Supply, 6 = uWave Base
                         * 5 = uWave Pls, 4 = PIR PLS
                         * 3 = PIR BASE 2 = Temp Comp
                         * 1 = uWave INF 0 = PIR INFORM
AVEHIGH     EQU    $008A      * High byte of running average
AVELOW      EQU    $008B      * Low byte of running average

AVECNTH     EQU    $008C      * High byte of average counter
AVECNTL     EQU    $008D      * Low byte of average counter

INTER H     EQU    $008E      * Intermediate ave high byte
INTER       EQU    $008F      * Intermediate ave low byte
INTCNT      EQU    $0090      * Intermediate counter

STFTLO      EQU    $0091      * Lower comparison value for baseline
STFTHI      EQU    $0092      * Upper comparison value for baseline
UPIR1       EQU    $0093      * Upper PIR Set Point Copy 1
UPIR2       EQU    $0094      * Upper PIR Set Point Copy 2
LPIR1       EQU    $0095      * Lower PIR Set Point Copy 1
LPIR2       EQU    $0096      * Lower PIR Set Point Copy 2
PPNUM       EQU    $0097
AVECNT      EQU    $0098

TESTNM      EQU    $0099      * Holds number of averages
ANSWLO      EQU    $009A      * Low byte of total ave
ANSWHI      EQU    $009B      * High byte of total ave
UWAVE       EQU    $009C      * uWave Alarm Status
RESCTL      EQU    $009D      * RES counter low byte
RESCTH      EQU    $009E      * RES counter high byte
```

```
ALRMCT      EQU    $009F      * Alarm timer counter
STIML       EQU    $00A0      * Low byte self test timer
STIMM       EQU    $00A1      * Medium byte self test timer
STIMH       EQU    $00A2      * High byte self test timer
POLAR       EQU    $00A3      * Polarity variable PIR signal
                         * F7 = Positive polarity
                         * F6 = Negative polarity
                         * F1 = Positive Out of Threshold
                         * P0 = Negative Out of Threshold
POSTHS      EQU    $00A4      * Positive Threshold Counter for PIR
NEGTHS      EQU    $00A5      * Negative Threshold Counter for PIR
                         * Informer

PIRCNT      EQU    $00A6      * PIR Informer Counter
UWAVNF      EQU    $00A7      * uWAVE Informer counter
UWAVC       EQU    $00A8      * Timer for uWave Alarm
PIRHIC      EQU    $00A9      * Timer for PIR Upper T Crossing
PIRLOC      EQU    $00AA      * Timer for PIR Lower T Crossing
STACNT      EQU    $00AB      * 15 sec timer for state counter
STA2C       EQU    $00AC      * 4 second timer state 2
TMPTIM      EQU    $00AD      * TEMP COMP time var
TTIML       EQU    $00AE      * Low byte of temp comp timer
TTIMH       EQU    $00AF      * High byte of temp comp timer
RES8        EQU    $00B0      * Byte zero of eight RES timers
                         * Do not use any bytes between
                         * B0-B7 inclusive
NEGINF      EQU    $00B8      * Negative Threshold Counter
DELTIM      EQU    $00B9      * Delta timer for RES
DELTA       EQU    $00BA      * Delta Timer Flag
PIRBCT      EQU    $00BB      * PIR Baseln counter up to 8
TROUB       EQU    $00BC      * TROUBLE PULSE WIDTH COUNTER
TRBSTA      EQU    $00BD      * TROUBLE STATUS
                         * B7 = DRIVE TROUBLE 8 SEC
                         * B6 = DRIVE TROUBLE 4 SEC
                        *No longer toggle trouble made it 0
        ORG    $0020
        FCB    $87    * ROM LED CODE AT $20 (ERCODE)
        FCB    $07    * ROM FLASH CODE AT $21
        FCB    $87    * RAM LED CODE AT $22 (ERCODE)
        FCB    $04    * RAM FLASH CODE AT $23
        FCB    $84    * PWR SUPPLY LED CODE AT $24 (ERCODE)
        FCB    $04    * PWR SUPPLY FLASH CODE AT $25
        FCB    $86    * uWAVE BASELINE LED CODE AT $26 (ERCODE)
        FCB    $04    * uWAVE BASELINE FLASH CODE AT $27
        FCB    $86    * uWAVE PULSE LED CODE AT $28 (ERCODE)
        FCB    $06    * uWAVE PULSE FLASH CODE AT $29
        FCB    $85    * PIR PULSE LED CODE AT $2A (ERCODE)
        FCB    $05    * PIR PULSE FLASH CODE AT $2B
        FCB    $85    * PIR BASELINE LED CODE AT $2C (ERCODE)
        FCB    $04    * PIR BASELINE FLASH CODE AT $2D
        FCB    $83    * TMP CMP LED CODE AT $2E (ERCODE)
        FCB    $03    * TMF CMP FLASH CODE AT $2F
        FCB    $87    * DUAL TECH FAILUBE LED CODE AT $30 (ERCODE)
```

```
        FCB   $03   * DUAL TECH FAILURE FLASH CODE AT $31

        end

*************************************************************
*     Real Time Interrupt Routine performs all timing related  *
*     user interfaces.  Flashes LEDs, Counts down self test    *
*     duration.  Peforms alarm timing etc.                     *
*     Also serves as the Microwave (Input Capture) Interrupt   *
*     vector Since it is shared, routine must poll the status  *
*     register to determine who interrupted                    *
*                                                              *
*************************************************************


        XREF BSCT:TESTYP,FLSHTM,LEDS,FLASH,PORTA
        XREF BSCT:TTIME,TSR,TCR,TCNTL,PORTB,OCRL,OCRH
        XREF BSCT:ICRL,ICRH,UWAVE,ALRMCT,STA2C
        XREF BSCT:RESCTL,RESCTH,STIML,STIMH,TSTAT
        XREF BSCT:UWAVC,PIRHIC,PIRLOC,STACNT,ATIMER,FAIL1
        XREF BSCT:DELTA,POLAR,DELTIM,STATE,STIMM
        XREF BSCT:TMPTIM,TTIML,TTIMH,TROUB
        XREF PSCT:COP
        XDEF TIMER

TIMER:
        BRCLR 7,TCP,TOVL  * Input Capture not enabled
        BRCLR 7,TSP,TOVL  * Input Capture didn't interrupt
        LDA ICRL          * Read low byte clear flag
        BSET 7,UWAVE      * Indicate uWave occured
        BSET 7,DELTA      * Start Delta Timer if nec
        BSET 1,PORTA      * Drive LED
        BCLR 7,TCR        * Disable IC until acknoledged
                    * By background routine
TOVL:       BRSET 5,TSR,CTIME
        JMP RETURN        * No Real Time Interrupt
CTIME:      LDA TSR       * Temporary Clear Status
        LDA TCNTL         *  Read lower byte clear I Flag
        CLRA
        STA COP
*****************************************NEW TROUBLE**********
        BRSET 7,TESTYP,CHTYPE DON'T PULSE IF PU OR UI
        TST TROUB         * Check trouble
        BEQ CHTYPE
        DEC TROUB         * DECREMENT TROUBLE COUNTER
        BNE CHTYPE
        BCLR 3,PORTA      * TROUBLE PULSE TIMED OUT
*************************************************************
CHTYPE:  LDA TESTYP       * Check to see if PU or UI ST
        AND #$E0          * HIGHEST PRIORITY
        BNE DISPLAY       * No Single Tec either
        LDA #$03
        AND STATE
```

```
        BEQ SKIPDP          * No Trouble no Display
        INC FLSHTM          * Else use a different Flash Rate
        LDA FLSHTM
        CMP #$06            * Slower Flash Rate
        BCS SKIPDP
        CLR FLSHTM
        BPA NOROM
SKIPDP:     BRSET 3,TESTYP,DISPLAY  * lowest priority T Comp error
        BRA CKALRM
DISPLAY: INC FLSHTM
        LDA FLSHTM
        CMF #$01                * Flash time (1/2 period)=
        BCS CKDUR               * 5 times .142 sec
        CLR FLSHTM              * Rezero
        BRCLR 6,TESTYP,NOROM    * If not ROM Test leave
        LDA PORTB               * Alarm Relay alone
        EOR #$20                * Else toggle it
        STA PORTB
NOROM:
        LDA LEDS
        EOR FLASH           * Flash those LEDs that Flash
        STA LEDS            * Do not toggle T relay

*********************************************************
        BRCLR 3,PORTA,NTROUB
        ADD #$08
*********************************************************

NTROUB:     STA FORTA

CKDUR:      LDA TTIME
        BEQ CKALRM
        DEC TTIME

CKALRM:     BRCLR 7,TESTYP,CTIMS
        JMP RETURN          * If PU ST leave alone

CTIMS:      BRCLR 7,ATIMER,CKDEL    * Check if in alarm
        DEC ALRMCT          * Decrement alarm counter
        BNE CKDEL
        BSET 5,PORTB        * CLEAR Alarm Relay
        BCLR 7,ATIMER
        BCLR 7,STATE
        TST TESTYP          * Don't clear LEDs if flashing code
        BNE CKDEL
        CLR PORTA           * Clear LEDs
CKDEL:      BRSET 6,STATE,CKRES     * RES don't inc counter
        BRCLR 7,DELTA,CKRES     * no delta timer continue
        BRSET 0,DELTA,DELTOG    * when set advance counter
        BSET 0,DELTA            * set up to inc it next time
        BRA CKRES               * don't increment counter this time
DELTOG: BCLR 0,DELTA            * set up so next time dosn't inc it
        INC DELTIM              * increment the counter this time
```

```
        BNE CKRES                 * continue to next timer
        COM DELTIM                * Keep at FF about 70 seconds

CKRES:      BRCLR 6,STATE,STATIM    * Check if RES is active
        INC RESCTL                * If so increment counter
        BNE STATIM
        INC RESCTH                * Propogate up
        LDA #$0E                  * 8.5 minutes
        CMP RESCTH                * Check if RES is Up
        BCC STATIM
        BCLR 6,STATE              * If so clear RES Flag
        CLR RESCTH

STATIM: BRCLR 4,ATIMER,STA1TM       * See if in State 2
        INC STA2C
        LDX STA2C
CKS1TO: CFX #$28                  * Compare 2 time out period
        BCS STA1TM
        BCLR 4,ATIMER             * If longer clear counter
        CLR STA2C
STA1TM: LDX #$07
        BRCLR 3,ATIMEP,UWTIME
        LDA #$72                  * 15 Second Timer
        INC STACNT
CKSTM1: CMF STACNT
        BCC UWTIME                * 15 Seconds not up
        BCLR 3,ATIMER             * Timed out no alarm
        CLR POLAR                 * Clear reference to Polarity
        CLR STACNT
UWTIME: LDA #$1E                  * 4 Second timer
        BRCLR 0,ATIMER,PIRTM      * No uWave Timing Required
        INC UWAVC
        CPX UWAVC
        BCC CKWVC
        TST TESTYP                * Don't keep clearing if
        BNE CKWVC                 * flashing another code
        BCLR 1,PORTA              * Clear uWave LED
CKWVC:  CMP UWAVC                 * Compare to 4 seconds
        BCC PIRTM                 * If less check PIR
        BCLR 0,ATIMER             * If longer clear counter
        CLR UWAVC
                    * 4 Second counter in Accum
PIRTM: BRCLR 1,ATIMER,CKLWCT * Check to see if High Counter
        INC PIRHIC                * Increment High T Counter byte
        CMP PIRHIC                * Compare to 4 Second timer in A
        BCC CKLWCT
        BCLR 1,ATIMER             * Clear alarm timer
        CLR PIRHIC                * Reset counter
        BRSET 3'ATIMEP,CKLWCT     * Don't clear Pos Pol if State 1
        BCLR 7,POLAR              * is still active else Clear PPF
        BCLR1,POLAR
CKLWCT: BRCLR 2,ATIMER,SELFTM       * No Low Counter leave
        INC PIRLOC
```

```
        CMF PIRLOC
        BCC SELFTM                  * Has not timed out
        BCLR 2,ATIMER               * Clear alarm timer
        CLR PIRLOC                  * Reset counter
        BRSET 3,ATIMER,SELFTM       * Don't clear Neg Pol if State
        BCLR 6,POLAR                * is still active else clear it
        BCLR 0,POLAR
SELFTM: LDA ATIMER
        AND #$06
        BEQ STIMER
        LDA PIRHIC                  * Take average of counts
        ADD PIRLOC                  * Clear if they are greater
        LSRA                        * than 8
        CMF #$04
        BCS STIMER
        TST TESTYP                  * Don't keep clearing LEDs if
        BNE STIMER                  * flashing another code

        BCLR 0,PORTA
STIMER: BRSET 5,STATE,TMPIT         * Self Test still pending
        INC STIML                   * Increment lower byte
        BNE TMPIT                   * NO ROLLOVER NO POSSIBILITY OF TEST
        INC STIMM                   * PROPAGATE ROLLOEVER
        BEQ HIBYTE                  * IF ZERO MOVE UP
        TST FAIL1                   * Test if in short st mode
        BEQ TMPIT                   * no go check temp timer
        LDA #$1A                    * yes see if 15 min ST timer is up
        CMP STIMM
        BCC TMPIT                   * not up go check temp comp

        BRA SET5                    * set st if 1900 for short interval
HIBYTE: INC STIMH                   * INCREMENT HIGH BYTE
        LDA #$09                    * check high byte long timer A0000
        CMP STIMH
        BCC TMPIT                   * not done, check temp comp
SET5: BSET 5,STATE                  * Set ST State (clears counts
                            * for trouble invoked st)
        CLR STIMM                   * CLEAR BYTES FOR NEXT
        CLR STIMH                   * LSB ALREADY CLEARED
TMPIT: BRSET 7'TMPTIM,RETUPN * temp comp variable already set
        INC TTIML                   * INCREMENT LOW BYTE OF TEMP TIMER
        BNE RETURN                  * NO ROLLOVER
        INC TTIMH
        LDA #$35                    * USE $3600 AS COUNTER 30.19 MIN
        CMF TTIMH
        BCC RETURN
        BSET 7,TMPTIM               * SET TIME FOR TEMP COMP VAR
        CLR TTIMH                   * TTIML ALREADY ZERO

RETURN:  RTI                        * Return from Interrupt

        end
```

```
*******************************************************
*     Initialization Routine, inits regs, vars, ports     *
*     Performs first part of Power Up Self Test           *
*     ROM, RAM tests                                      *
*     Routine entered only by Power Up, User Invoke or    *
*     Command Input Self Test                             *
*                                                         *
*******************************************************


        XREF BSCT:DDRC,DDRD,SCR,DDRA,DDRB,PORTA,PORTB,PORTD
        XREF BSCT:FLSHTM,TTIME,TCR,ADSCR,TESTYP,LEDS,FLASH
        XREF BSCT:TSTAT,STPTHI,STPTLO,PPNUM,PORTC,TSR,ATIMER
        XREF BSCT:ADDR,TESTNM,ANSWLO,ANSWHI,UPIR1,UPIR2
        XREF BSCT:LPIR1,LPIR2,STATE,OCRL,ICR
        XREF PSCT:CHKPWR,COP
        XREF BSCT:DELAY,LEDRIV
        XDEF INIT


            ORG $0100
                * Port D5 output low
INIT:  BSET 5,DDRD          * enables uWave Osc.
            BCLR 5,PORTD
            CLRA
            STA COP
            CLR SCR         * Disable SCR
            CLR FLSHTM      * Init Flash period
            CLR ATIMER
            CLR STATE       * Init State
            LDA #$0F        * Set 3-0 to outputs
            STA DDRA        * Set 7-4 is input
            BSET 3,PORTA    * DRIVE TROUBLE FOR TEST DURATION
            LDA #$A0
            STA DDRB        * B7&B5 Out B6 in, Rest Don't Care
            LDA #$C0        * Power Up Self Test
            STA TESTY       * Toggle Alarm Relay for 5 Seconds
            LDA #$15        * Store ROM test time duration
            STA TIME        * Test Time Var decremented in
            LDA #$20        * Timer Module, read here
            STA TCR         * Disable Input Capture,
                            * Disable Output Compare
                            * Enable Timer Overflow
                            * Falling Edge on TCAP
                            * Low Output on TCMP
            LDA #$23
            STA ADSCR       * A/D on, chan 3 selected (p.s.)
ROMTS:
            CLR PORTB       * Drive alarm (5 seconds)
            LDX #$20
                        * Keep IRQ disabled externally
            JSR LEDRIV      * ($20 is also address to ROM codes)
                            * Store display code in LEDs
```

```
                CLRX
                JSR DELAY          * LET MICROWAVE POWER UP
                JSR DELAY
                CLI                * Allow Timer Overflow interrupts
ROM2:           CLRX               * Start at beginning of ROM
                CLRA               * Because there is only an 8 bit
                STA COP
ROM1  EOR   $0100,X      * index reg, can only test 256
      EOR   $0200,X      * saves having eight loops
      EOR   $0300,X      * final result is the same
      EOR   $0400,X      * checksum held in last byte
      EOR   $0500,X      * of ROM
      EOR   $0600,X
      EOR   $0700,X
      EOR   $0800,X
      INCX
      BNE ROM1
                    * TSTA No CHKSUM is being performed
                    * BNE ROM2 If fails repeat
      TSTA
      BNE ROM2
      STA COP            * Hit Dog CAN'T USE BCLR ONLY
RMTIM:  LDA TTIME        * Check to see if time is up
      BNE ROM2           * Still in self test
      BCLR 6,TESTY       * Clear alarm toggle flag
      BSET 5,PORTB       * clear alarm
                    * Drive LEDs and Trouble
RAMTST: LDX #$22         * Put in Flash Code for RAM
      JSR LEDRIV         * $22 is address to RAM LED codes
      LDA #$15
      STA TTIME
TRAM:  LDX #$88          * Leave LED, FLASH etc vars alone
TRAM1:  LDA #$AA         * Alternating bits
      STA ,X
      CMP ,X
      BNE RAMTST
      COMA               * Other alternating bits
      STA ,X
      CMP ,X
      BNE RAMTST
      CLRA
      STA ,X             * Init bytes to zero
      STA COP            * Hit Dog
      INX
      BNE TRAM1
RATIM:
      LDA TIME
      BNE TRAM
                         * Go to ongoing portion of ST
                         * load right after init with
                         * linker
      END
```

```
        XREF BSCT:LEDS,PORTA,FLASH
        XDEF LEDRIV
* Commonly used LED Routine, Xreg points to lookup table
* display codes for LEDs and FLASHing
*

        ORG $0040    * ROM CRUCH DO NOT ADD TO THIS ROUTINE
                     * IT IS 15 BYTES AND WILL NOT FIT HERE
                     * IF ADDED TO!!!!!!!!!!!!

LEDRIV:  LDA ,X      * get the led code
        STA LEDS     * store it in LED var
*************************************************************
        BRCLR 3,PORTA,DRVIT
        ADD #$08     * maintain trouble state
*************************************************************
DRVIT: STA PORTA          * drive the LEDs
        INX               * get the flash code
        LDA ,X
        STA FLASH         * store it in the FLASH var
        RTS

        END


        ****************************************************
        * This routine is the core of Self Test            *
        * First it performs the Power Supply Test          *
        * Next it looks at the Microwave baseline          *
        * Next it looks at for the Microwave receive pulse *
        * Next it performs a transient test on the PIR Amp *
        * Next it measures the PIR baseline                *
        * Finally it Temperature Compensates the PIR       *
        * Alarm threshold                                  *
        *                                                  *
        ****************************************************



        XREF BSCT:PORTA,PORTB,DDRA,TMPTIM,PIRBCT
        XREF BSCT:FLSHTM,TTIME,TCR,ADSCR,TESTYP,LEDS,FLASH
        XREF BSCT:TSTAT,STPTHI,STPTLO,PPNUM,PORTC,TSR
        XREF BSCT:ADDR,TESTNM,ANSWLO,ANSWHI,UPIR1,UPIR2
        XREF BSCT:LPIR1,LPIR2,STATE,OCRL,ICRL,FAIL1,ERCODE
        XREF BSCT:TRBSTA,TROUB
        XREF PSCT:BASELN,BCKGND,COP,INIT,STINVK
        XREF BSCT:DELAY,LEDRIV
        XDEF CHKPWR,RESTOR,TMPCMP

CHKPWR:     LDA #$23
        STA ADSCR         * A/D on, chan 3 selected (p.s.)
        BRCLR 7,TESTYP,PWRSP    * If on going leave LEDS alone
```

```
        BRA PSLED                 * Else drive LEDs
PSFAIL:
        BRSET 7,TESTYP,PSEPR      * If fail PU ST drive LEDs

        BRSET 7,FAIL1,PSTRBL      * 2nd error dsp LEDs keep testing

        BSET 7,FAIL1              * 1st time Go into suspect mode
        BRA CHKWAV                * do rest of On Going Test
*********************************************************
PSTRBL: BFSET 2,TESTYP,PSERR * ONLY PULSE TROUBLE ONCE
                                  * BUT LOOP ON ERROR
        BSET 6,TROUB              * DRIVE TROUBLE FATAL ERROR
        BSET 3,PORTA
*********************************************************
PSEPR:  BSET 2,TESTY              * Indicate has failed twice
        LDA #$24
        STA ERCODE                * Store PS error clear others
PSLED:  LDX #$24
        JSR LEDRIV                * Don't save if already have it
                                  * Put out proper code Disable ext
                                  * interrrupt
PWRSP:  LDA #$8C                  * 2.75 Volts
        STA STPTHI                * Store upper Setpoint (PS)
        LDA #$73                  * 2.25 Volts
        STA STPTLO                * Store lower Setpoint (PS)

        LDA #02                   * Default to On Going
        STA TESTNM                * Call PS Routine only twice

        BCLR 7,TSTAT              * Default to test pass
        JSR BASELN
        BRSET 7,TSTAT,PSFAIL      * Fail Loop
        BRCLR 2,TESTYP,CLRPS1     * If had failed restart self test
        JMP INIT                  * else continue (FATAL Error)
CLRPS1: BCLR 7,FAIL1              * Else clear fail once error


CHKWAV:
        BRCLR 7,TESTYP,WAVSP      * Leave LEDs alone if On Going
                                  * Put out proper code on LEDs
UWFAIL: LDX #$26                  * Put out toggle
        JSR LEDRIV                * Disable irq if pu
                                  * Toggle only one LED
WAVSP: LDA #$21
        STA ADSCR                 * Select uWave A/D in
        LDA #$7E                  * Upper Setpoint is 2.46 V
        STA STPTHI                * Baseline below 3.75 Volts?
        LDA #$56                  * Lower Setpoint is 1.68 V
        STA STPTLO
        BCLR 7,TSTAT              * Default to passed test
        LDA #02                   * Default to On Going
        STA TESTNM                * Call it only twice
        JSR BASELN                * go average
```

```
        BRCLR 7,TSTAT,UWVSUP     * Check to see if pass or fail
                                 * Go to next test if pass
        CMP STPTHI               * Result is in accum
        BCC UWHFAL               * High is an instant failure
                                 * must be low check if comparitor
        BRCLR 2,PORTC,UWVSUP     * low than ignor else indicate err
UWHFAL: BRSET 7,TESTYP,WAVSP     * Loop if PU Self Test
        BRSET 6,FAIL1,UW1ERR     * ALREADY HAD ONE ERROR NOW
        BSET 6,FAIL1             * FIRST TIME ERROR
        BRA SUPWAV               * GO TO NEXT TEST

UW1ERR:  LDX #$26
        STX ERCODE               * STORE UWAVE ERROR CLEAR OTHERS
        BSET 0,TESTYP            * set single tec bit PIR

        BSET 0,TSTAT
                                 * Put out proper code on LEDs

NOUWTB: BRA SUPWAV               * and drive new LED code
UWVSUP: BCLR 6,FAIL1             * PASSED CLEAR SUSPECT MODE
        BCLR 0,TSTAT             * Clear ST PIR BIT
        BRSET 2,TSTAT,NOWAV      * If P uWave error skip else
        BCLR 0,TESTYP            * Clear Single Tec uWave
NOWAV:
        JSR RESTOR               * Clear LEDs if no other errors
SUPWAV:  BRCLR 7,TESTYP,SLOOP        * Leave LEDs alone if On Going
                                 * Put out proper code
        LDX #$28                 * Toggle two LEDs & T Relay
        JSR LEDRIV
DOOVER:  JSR DELAY               * SETTLE OUT USE X HIT DOG
        LDA #$15                 * START TEST TIMER
        STA TTIME
SLOOP:  BRCLR 7,PORTA,SUPTRB
        BCLR 5,FAIL1
        BCLR 2,TSTAT             * CLEAR uWave Pulse error
        BRSET 0,TSTAT,CKTTYP     * IF Don't HAVE ANOTHER UWAVE
        BCLR 0,TESTYP            * CLEAR STPIR ELSE LEAVE ALONE
CKTTYP:  BRCLR 7,TESTYP,CKSTAT            * On going get out
        JSR STINVK               * check command input & STINVK
        LDA TTIME                * PU do tell time up
        BNE SLOOP
        BRA CKSTAT
SUPTRB: BRSET 7,TESTYP,DOOVER        * PU RESET ST TIME
        BRCLR 5,FAIL1,CKSTAT
        BSET 0,TESTYP            * set to single tec PIR bit
        BSET 2,TSTAT

PULUWR:  LDX #$28                * set error code
        STX ERCODE

CKSTAT: JSR RESTOR               * Clear LEDs if no other error
KPSTAT: LDA #$20
        STA ADSCR                * Select PIR A/D in
```

```
        BRCLR 7,TESTYP,HITIT     * Leave LEDs alone if On Going
        LDA #$15
        STA TIME                 * Set Up User Interface Time
        LDX #$2A                 * Drive LEDs
        JSR LEDRIV
HITIT:  BSET 7,PORTB             * Drive amplifier
        CLR PPNUM                * First Pass at PPIR
READPL: LDX #$32                 * X with 50
        JSR DELAY                * (about a 40 mSec Delay)
CONTPP:  CLR ANSWLO
        CLR ANSWHl
        LDX #04
LOWSAP:  BCLR 7,ADSCR            * Start conversion
README:  BRCLR 7,ADSCR,README
        LDA ADDR                 * Read A/D clear flag
        ADD ANSWLO
        STA ANSWLO               * Add to previous byte
        CLRA
        ADC ANSWHI               * Propagate carry
        STA ANSWHl
        DECX                     * Add four samples
        BNE README
        LDA ANSWLO
        LSR ANSWHI               * divide by four
        RORA
        LSR ANSWHl
        RORA
        BRCLR 7,PPNUM,PLOW       * If low one go to it
        CMF #$4D                 * < 1.509 Volts
        BCC PFAIL
        BCLR 4,FAIL1             * clear any old failure
        BRCLR 3,TSTAT,NOCLR
        BCLR 3,TSTAT             * CLEAR PIR Pulse error
        BRCLR 1,TSTAT,CKCODE     * If had baseline error leave
        BCLR 1,TESTYP            * ST bit alone else clear it
CKCODE:
        JSR RESTOR               * Clear LEDs if no other errors
NOCLR:  BRCLR 7,TESTYP,PIRBAS        * ON GOING Don't Wait
        BRA WAIT                 * PU Wait then Go Check Baseline
PLOW:
        CMP #$B2                 * >3.49
        BCC TLOW                 * Passed go toggle low
PFAIL:  BCLR 7,PORTB     * if 1st half clear try again if second
                                 * already cleared but don't care
        JSR DELAY
        BRSET 7,TESTYP,HITIT     * PU GO BACK
        BRSET 4,FAIL1,DECLR      * ALREADY HAD A FAILURE
        BSET 4,FAIL1             * INDICATE FAILURE
        BRA WAIT
DECLR:
        BSET 3,TSTAT             * set failure bit
NOPPTB: BSET 1 ,TESTYP           * Set Single Tec uWave
        BCLR 7,PORTB             * return to low
```

```
        LDX #$2A                  * STORE ERROR CODE
        STX ERCODE
        CLRX                      * Delay 200 mili seconds
        JSR DELAY
        BRA PIRBAS                * On Going go read baselin
TLOW:   CLRX                      * set up approx 400 milisec delay
        JSR DELAY                 * plus the 40 mSec delay above
        JSR DELAY
        JSR DELAY
        BCLR 7,FORTB              * Drive Port B bit 7 low
        BSET 7,PFNUM              * Second Pass through PPIR Loop
        BRA READPL                * Toggle Port High
WAIT:   JSR STINVK                * KICK DOG
        LDA TTIME                 * Wait some time befor continuing
        BNE WAIT
PIRBAS:
        CLRX                      * Delay 400 mSeconds
        JSR DELAY
        JSR DELAY
        BRCLR 7,TESTYP,PIRSP      * Leave LEDs alone if On Going
        LDX #$2C                  * Toggle only one LED & T Relay
        JSR LEDRIV
PIRSP:  LDA #$08
        STA PIRBCT
AAGAIN: LDA #$8C                  * Upper Setpoint is 2.75V
        STA STPTHI
        LDA #$73
        STA STPTLO                * Lower Setpoint is 2.25 V
        BCLR 7,TSTAT
        LDA #02                   * Default to On Going
        STA TESTNM                * Call it only twice
        JSR BASELN                * go average
        BRCLR 7,TSTAT,ENDPIR      * Check to see if pass or fail
                                  * Go to end of PIR if pass
        DEC PIRBCT
        BNE AAGAIN
        BRSET 3,FAIL1,BFAIL       * FAILED BEFORE DECLARE ERROR
        BRSET 7,TESTYP,PIRSP      * PU CONTINUE TESTING
        BSET 3,FAIL1
        BRA TMPCMP
BFAIL:  BSET 1,TESTYP             * Set single tec uWave bit

        BSET 1,TSTAT              * Indicate type of failure

NOPBTB: LDX #$2C                  * STORE THE ERROR CODE
        STX ERCODE
        BRA TMPCMP                * Don't Restore since in failure
ENDPIR: BCLR 1 ,TSTAT             * CLEAR PIR Baseline error
        BCLR 3,FAIL1              * CLEAR FAILURE ERROR
        BRSET 3,TSTAT,CKLEDS      * If PIR Baseline error
        BCLR 1,TESTYP             * leave STuWAVE alone else clear it
CKLEDS:
        JSR RESTOR                * Clear LEDs if no other errors
```

```
TMPCMP:  LDA #$22
         STA ADSCR                 * Select Temp Comp A/D in
         BRCLR 7,TESTYP,TMPSP      * Leave LEDs alone if On Going
         BRSET 7,TMFTIM,TMPSP      * leave LEDs alone if Temp Comp
         LDX #$2E                  * Put out proper code
                                   * Toggle uWave & PIR LEDs & T Relay
         JSR LEDRIV                * Drive LEDs
TMFSP:   LDA #$E1                  * Upper boundry is 4.3 V
         STA STPTHI
         LDA #$2A
         STA STPTLO                * Lower boundry is .85 V
         BCLR 7,TSTAT
         LDA #02                   * Default to On Going
         STA TESTNM                * Call it only twice
         JSR BASELN                * go average
         BRCLR 7,TSTAT,TMPPAS      * Check to see if pass or fail
                                   * Within bounds go compensate
         BRSET 7,TESTYP,TMPSP      * Loop for PU ST
         BRSET 2,FAIL1,TMFAIL      * Already had a failure
         BSET 2,FAIL1              * SET SUSPECT MODE
         BRA NOTLED                * USE DEFAULT SET POINTS
TMFAIL:  BSET 3,TESTYP             * Indicate on LEDs error
         BSET 4,TSTAT
         LDA TESTYP                * Low priority error don't
         AND #$03                  * drive if other errors exist
         BNE NOTLED                * Else
                                   * Indicate Trouble
         LDX #$2E                  * Save previous status
         STX ERCODE
NOTLED:  LDA #$99                  * Default to 3.0V
         LDX #$66                  * Default to 2.0V
         BRA DONETC                * Store & monitor
TMPPAS: BCLR 2,FAIL1               * Passed clear any suspect mode
TEMPIT: BCLR 4,TSTAT
         BRCLR 3,TESTYP,CONTMP
         BCLR 3,TESTYP             * Clear Temp Comp Error
         JSR RESTOR                * Clear LEDs if no other errors
CONTMP: CMP #$8C                   * Check to see if < 8C
         BCC HIGHER                * > 8C BRANCH
         CMP #$7C
         BCC CHKNXT                * > 7C BRANCH
         CMP #$73
         BCS LOWEST                * < 73 BRANCH
         LDA #$9B                  * 3.05 V
         LDX #$63                  * 1.95 V 73 <DATA <7C (22-24 Deg C)
         BRA DONETC
LOWEST:  LDA #$9E                  * 3.1 V <73 (<22 Deg C)
         LDX #$61                  * 1.9 V
         BRA DONETC
CHKNXT:  CMP #$84
         BCC MIDDLE                * > 84 BRANCH
         LDA #$99                  * 3.0 V  7C <DATA  <84 (24 to 27 C)
```

```
        LDX #$66                * 2.0 V
        BRA DONETC              * Go write the setpoints

MIDDLE:  LDA #$96               * 2.94 V 84 <DATA <8C (27 to 29 C)
        LDX #$68                * 2.04 V
        BRA DONETC              * Go write the setpoints
HIGHER: CMP #$9C
        BCC MOREHI              * > 9C BRANCH
        CMP #$95
        BCS NTSOHI              * < 95 BRANCH
        LDA #$8E                * 2.78 V 95 <DATA <9C (34 to 37 C)
        LDX #$71                * 2.216 V
        BRA DONETC
NTSOHI:  LDA #$8F               * 2.804 V 8C <DATA <95 (29 to 34 C)
        LDX #$70                * 2.196 V
        BRA DONETC
MOREHI:  CMP #$AB
        BCC HIGHST
        LDA #$94                * 2.9 V 9C <DATA <AB (37 to 40 C)
        LDX #$6B                * 2.1 V
        BRA DONETC              * Go write the setpoints
HIGHST:  LDA #$96               * 2.95 > AB (>40 Degrees C)
        LDX #$69                * 2.156
DONETC: STA UPIR1               * Upper Setpoint 1
        STA UPIR2               * Upper Setpoint 2
        CMP UPIR1
        BEQ OK1
RFAIL:  JMP INIT
OK1:    CMP UPIR2
        BNE RFAIL
        STX LPIR1               * Lower Setpoint 1
        STX LPIR2               * Lower Setpoint 2
        CPX LPIR1
        BNE RFAIL
        CPX LPIR2
        BNE RFAIL
        BCLR 7,TESTYP           * Clear PU ST Status
        LDA #$20
        STA ADSCR               * Select PIR A/D in
        LDA TESTYP

        BEQ GOMON               * No error restore
        AND #$03
        CMP #$03                * Dual Tec Failure
        BNE LEDERR              * Not dual error but have error
*       BNE GOMON               * No continue
        LDX #$30                * PUT IN ERROR CODE
        STX ERCODE
LEDERR:

        BRSET 7,TRBSTA,NOSTTB
        BSET 7,TRBSTA
        BSET 6,TROUB
```

```
        BSET 3,PORTA

NOSTTB:  LDX ERCODE
        JSR LEDRIV
        BSET 5,TESTYP           * HAVE ERROR DRIVE ST DIPLAY
        CPX #$31                * had incremented in subroutine
        BNE GOMON               * Get out of st if single tec
        JMP CHKPWR              * Loop on Self Test
GOMON:  JSR RESTOR              * Clears LEDs if no problem
        BCLR 5,STATE            * Done with On Going
        BCLR 7,TMPTIM           * Clear Temp Comp Var
        LDA TSR
        LDA ICRL
        LDA #$A1
        STA TCR                 * Enable Input Capture
*************************************************************
        TST TROUB               * DON'T CLEAR IF PULSING FOR
        BNE TOBKGN              * ANOTHER TEST
        BCLR 3,PORTA            * CLEAR TROUBLE DONE WITH TEST
*************************************************************
TOBKGN:  JMP BCKGND

RESTOR:  LDA TESTYP
        AND #$0F
        BNE KEEP
        BCLR 5,TESTYP           * CLEAR LED DISPLAY
*************************************************************
        BCLR 7,TRBSTA           * CLEAR TROUBLE PULSE LATCH
*************************************************************
        BRSET 1,STATE,KEEP      * If trouble keep LEDs
        BRSET 0,STATE,KEEP
*************************************************************
        CLR LEDS
        LDA #$08                * PRESERVE TROUBLE STATE
        AND PORTA
        STA PORTA
        CLR FLASH
KEEP:   RTS

        END


*************************************************************
*       Assumes A/D is Set Up, Comparison Values are set up     *
*       Number of Reps is Set Up, LED codes are set up Flash    *
*       Used in conjunction with the Averaging routine to       *
*       sample a self test node via the A/D many times and take *
*       the average of the result. This result is then          *
*       compared and a pass or fail flag passed on to Chkpwr    *
*                                                               *
*************************************************************

        XREF BSCT:ANSWLO,ANSWHI,TESTYP,FLSHTM,LEDS
```

```
        XREF BSCT:TESTNM,AVELOW,TSTAT,STPTLO,STPTHI
        XREF PSCT:AVER
        XDEF BASELN
BASELN:
        CLR ANSWLO              * Initialize answer vars
        CLR ANSWHI
        BRCLR 7,TESTYP,ONGO     * Check Test Type
                                * On Going Test (no LEDs)
        LDA #$04                * PU Test, run AVER 4 times
        STA TESTNM
ONGO:
        JSR AVER                * Read A/D and average
        LDA AVELOW              * Get result
        ADD ANSWLO              * Add it to final average
        STA ANSWLO
        CLRA
        ADC ANSWHI              * Propagate the carry
        STA ANSWHI
        DEC TESTNM              * Check to see if need to
        BNE ONGO                * go run the average routine again
        LSR ANSWHI              * Else divide by two
        ROR ANSWLO
        BRCLR 7,TESTYP,COMPAR   * Check to see if PU or On Going
        LSR ANSWHI              * If PU divide by 4
        ROR ANSWLO
COMPAR:
        LDA ANSWLO              * Get the average result
        CMP STPTHI              * Compare it with High Setpoint
        BCS CHKLSP              * If OK go check lower Setpoint
SPFAIL
        BSET 7,TSTAT            * Indicate test failure
        BRA OVER
CHKLSP
        CMP STPTLO              * Compare it with lower setpoint
        BCS SPFAIL              * had a lower failure
        BCLR 7,TSTAT            * indicate passed test
        OVER RTS                * return from subroutine

            end

*************************************************************
* Averaging Routine                                         *
* Used in Power Supply, Microwave, PIR (and Thermister)     *
* base line averaging. Requires that the A/D mux already    *
* be pointing at the correct channel, Returns the average   *
* value as an 8 bit number in memory location AVELOW        *
* 256 values are summed and averaged. These 256 averages    *
* are summed and averaged themselves to yield a total of    *
* 65536 summations and a divide by 65536. The routine       *
* takes approx. 1.37 seconds. It is called four times for   *
* each baseline average on power up and user invoked, it is *
* called only once for the P.S. test in "On Going" and      *
```

```
* twice for the uWave and PIR baseline tests in "On Going".  *
*                                                            *
**************************************************************

      XREF BSCT:ADSCR,AVELOW,AVEHIGH,AVECNT,INTERL,INTERH
      XREF BSCT:PORTD,ADDR
      XREF PSCT:STINVK
      XDEF AVER

AVER: BCLR 7,ADSCR            * Start A/D
      CLR AVELOW              * Inlt Vars
      CLR AVEHIGH
      CLR AVECNT
      CLR INTERL
      CLR INTERH
SAMSUM: CLRX                  * Zero intermediate counter
STATUS:  JSR STINVK           * Read User Invoke Self Test
                              * and Command Input, kick dog
      BRCLR 7,ADSCR,STATUS    * Read Conversion Complete Flag
      BCLR 7,ADSCR            * Re-Start the A/D
      LDA ADDR                * Read A/D
      ADD INTERL              * Add it to intermediate (low byte)
      STA INTERH              * Store it back
      CLRA
      ADC INTERL              * Add carry to high intermediate byte
      STA INTERH
      INCX
      PNE STATUS              * ADD 256 COUNTS
AVER1:  LSR INTER             * Devide by 256 (shifT right 8 times)
      ROR INTERL              * High byte then low byte
      INCX
      CPX #8
      BLO AVER1
      ADD AVELOW        * Take this average add it to outer loop
      STA AVELOW        * average
      CLRA
      ADC AVEHIGH             * Propagate carry up to high byte

      STA AVEHIGH
      INC AVECNT
      BNE SAMSUM              * Check if 256 summations have occured
DEVIDE:  LSR AVEHIGH          * If so divide by 256
      ROR AVELOW
      DECX
      BNE DEVIDE
      RTS

      END


**************************************************************
*     This Background Routine contains the core of           *
*     of the alarm signal processing and the INFORMER        *
```

```
*     This routine works with the Real Time Interrupt          *
*     routine (Timer) and the IRQ interrupt routine            *
*     to determine timing, microwaves, microwave               *
*     supervision.  Both Dual Tec and Single Tec alarm         *
*     processing are performed in this routine                 *
*                                                              *
****************************************************************

      XREF PSCT:COP,CHKPWR,INIT,RESTOR,TMPCMP,STINVK
      XREF BSCT:STATE,PORTD,TESTYP,ADSCR,ADDR,ALRMCT
      XREF BSCT:PIRCNT,NEGTHS,ATIMER,LEDS,FLASH,POSTHS
      XREF BSCT:PORTA,UWAVNF,LPIR1,LPIR2,UPIR1,UPIR2
      XREF BSCT:TCR,UWAVE,ICRL,TSR,PORTB,PIRHIC,STA2C
      XREF BSCT:UWAVC,PIRLOC,STACNT,TSTAT,POLAR,TMPTIM
      XREF BSCT:NEGINF,DELTIM,FAIL1,DELTA,RES8,RESCTH
      XREF BSCT:STIMM,STIMH,TROUB,TRBSTA
      XREF BSCT:DELAY
      XDEF BCKGND

BCKGND: JSR STINVK            * check st kick dog
      BRCLR 7,TMPTIM,CKSTPY   * Time to Temp Comp
      JMP TMPCMP              * Yes go do it.
CKSTPY:  BRCLR 0,TESTYP,CONTIN
      JMP STPIR               * Check is Single Tec PIR
CONTIN:  LDA TSR              * Make sure clear Flag
      LDA ICRL                * Before enable int else
      LDA #$A0                * it will interrupt
      STA TCR                 * Enable Input Capture
      BRCLR 1,TESTYP,RDPIR    * Check if single Tec uWave
      JMP UWAV1               * Go process single Tec Alarms
RDPIR:  JSR RDATOD            * read A/D twice return average
      JSR PIRCHK              * Perform PIR Alarm Cornparison
      BRCLR 3,STATE,GTPIRIN
      JMP STATE1
GTPIRN:  TST NEGINF           * See if negative threshold
      BEQ CKUWA               * If zero alone
      JSR PIRINF              * Else check PIR informer
CKUWA:  BRSET 7,UWAVE,PRCSUW
      JMP CKST                * LONG JUMP NO UWAVE
PRCSUW: BSET 0,ATIMER         * PROCESS UWAVE
      CLR UWAVE               * Clear flag
      LDA ATIMER              * See ifa  PIR is occurring too
      AND #$06
      BEQ CKUWST              * No continue with informer
      BSET 3,STATE            * Had a uWave and PIR - State 1
      JMP STATE1
CKUWST:  BRCLR 0,STATE,CLPIRN
      BCLR 0, STATE
      CLR FLASH               * clear flash codes
      CLR LEDS
****************************************************************
      BCLR 6,TRBSTA           * CLEAR INFORMER TROUB LATCH
****************************************************************
```

```
CLPIRN:  CLR PIRCNT            * Had a uWave clear PIR
      CLR NEGINF
      BCLR 1,FAIL1
      LDA #$86
      AND ATIMER
      BNE NOLDS                * leave LEDs alone if in alarm
      TST TESTYP               * Or if self test error
      BNE NOLDS
      LDA #$02
      AND PORTA
      STA PORTA

NOLDS:  BRSET 6,STATE,CNTWAV   * RES don't inc informer
      LDA UWAVNF               * get informer
      AND #$07                 * subtract eight
      TAX                      * transfer to index reg
      LDA DELTIM               * Get timer
      STA RES8,X               * store it in array
      CLR DELTIM               * Rezero it
      INC UWAVNF               * increment uWave informer
      LDX #$07                 * check if had 8 use X for index too
      CPX UWAVNF               * leave if not else
      BCC CHTWAV               * add up last 8 delta times
      CLRA
ADDTIM:  ADD RES8,X
      BCS UWAV16               * if time > 70 sec leave
RESADD: DEX                    * Add all eight
      BPL ADDTIM
      BSET 6,STATE             * no carry hence < 70 set RES
UWAV16:  LDA #$0F
      CMP UWAVNF
      BCC CNTWAV
      STA UWAVNF               * Keep count at 16
*************************************************************
      BSET 1,STATE             * Trouble uWave
                               * comment out for GTEM
*************************************************************
      JSR CLERCT               * Clear other counters
      BCLR 3,TESTYP            * Clear low priority temp comp
      BCLR 4,TSTAT             * error if exists
      LDA #$06                 * Put out error Code
      STA FLASH
      STA LEDS
*************************************************************
      BRSET 6,TRBSTA,NOUWTR
      BSET 6'TRBSTA            * SET FLAG FOR DRIVING TROUBLE
      BSET 5'TROUB             * Drive Trouble
      BSET 3,PORTA             * for 4 seconds
*************************************************************
NOUWTR:  BRSET 0,FAIL1,CNTWAV       * Already in short st mode
      BSET 5,STATE             * do a self test
      BSET 0,FAIL1             * put in short self test mode
      CLR STIMM                * clear significant st counters
```

```
        CLR STEMH
CNTWAV:
        LDA TSR                 * Clear any flag
        LDA ICRL
        BSET 7,TCR              * Re-enable IC Interrupt
CKST:   JSR STINVK              * Check for ST or CI
**********Don't ST if pending***************
        LDA STATE               * DON'T ST or temp comp if
        AND #$98                * pending alarm
        BNE GOTOAD
        BRCLR 7,TMPTIM,ONGOTM   * time to tmp comp?
        JMP TMPCMP              * yes
ONGOTM: BRCLR 5,STATE,GOTOAD        * No Self Test Continue
        BCLR 7,TCR              * DISABLE IC
        JMP CHKPWR
GOTOAD: JMP BCKGND              * long jump to rdpir
*******************SINGLE TEC PIR****************************
STPIR:  CLR POLAR               * Clear reference to polarity
        CLR POSTHS              * First threshold crossing moves
        CLR NEGTHS              * unit into state 1
        BCLR 7,TCR              * Disable uWave interrupts
        JSR STENVK              * Kick Dog during wait period
        LDA #$86                * let the timers time out
        AND ATIMER
        BNE STPIR               * Don't continue until they have
STST:   JSR STINVK              * Check if ST or CI active
        BRCLR 5,STATE,CSTPIR    * No On Going continue ST PIR
        JMP CHKPWR              * ST int < tmp in single tec don't tc
CSTPIR: JSR RDATOD              * read A/D
        JSR PIRCHK              * go compare
        LDA ATIMER
        AND #$06            * no alarm stay in state until self test
        BEQ STST
                            * had an alarm go on to state 1 now
*************************************************************
STATE1: BCLR 7,TCR          * Disable uWave interrupts
                            * for the duration of State 1
        CLR PIRCNT          * clear PIR INFORMER
        CLR NEGINF
        BSET 3,ATIMER
STA1AD: BRSET 1,PORTA,CKS1PI        * If uWave LED is out
        BCLR 0,ATIMER       * clear rest of timer
        CLR UWAVC
CKS1PI: BRSET 0,PORTA,CKSTST        * If PIR LED is out
        BCLR 1,ATIMER       * Clear rest of timers
        BCLR 2,ATIMER       * else wait until LED is out
        CLR PIRHIC
        CLR PIRLOC
CKSTST: JSR STINVK
        BRSET 3,ATIMER,RDS1AD
        LDA #$E0                * Timed out restart
        AND STATE
        STA STATE
```

```
        LDA #$87
        AND ATIMER
        STA ATIMER
        JMP BCKGND          * Time out start over
RDS1AD:  JSR PDATOD         * Read PIR A/D
        TAX                 * SAVE COPY FOR HYSTERESIS PROCESS
        CMP UPIR1           * Compare it with upper threshold
        BCS HADPOS          * less than -> go see if had one before?
        BRSET 7,POLAR,CKPTHS    * is greater, had one before?
        BSET 7,POLAR        * No Set Positive Polar
        BCLR 1,POLAR        * Clear Pos Out of Threshold
        LDA #$30            * Set up counter
        STA POSTHS
        CLR PIEHIC          * drive LED
        BSET 1,ATIMER
        BSET 0,PORTA
        BRA STA1AD          * Go try again
CKPTHS:  BRCLR 1,POLAR,STA1AD       * yes but not out of pos thrs
        BSET 1,ATIMER       * WATCH OUT SIMULTANEOUS TEARS
        BRA MVST2           * HAD ONE,OUT OF THRS,PUL CNT 2
HEADPOS:  BRCLR 7,POLAR,CKNGTS      * No previous positive
        ADD #$03            * 60 mVOLTS HYSTERESIS
        CMP UPIR1           * DONT DEC IF VALUE IS HIGHER
        BCC STA1AD          * AFTER ADDING 60 mVolts
        DEC POSTHS          * Had previous positive dec counter
        BNE CKNGTS          * didn't count out go check neg
        BSET 1,POLAR        * Counted out set Pos Out of Thres
CKNGTS:  TXA                * RETRIEVE COPY IF NEEDED FROM HYSTERIS
        CMP LPIR1           * Check if less than neg thrs
        BCC HADNEG          * Go see if had neg
        BRCLR 6,POLAR,SETNEG    * No neg go set it
        BRCLR 0,POLAR,STA1AD    * Not out of neg thresh
        BSET 2,ATIMER       * WATCH OUT SIMULTANEOUS TIMERS
        BRA MVST2           * qualified go to state 2
SETNEG: BSET 6,POLAR        * Set neg polar flag
        BCLR 0,POLAR        * clear neg out of thres flag
        LDA #$30
        STA NEGTHS
        CLR PIRLOC          * Drive LED
        BSET 2,ATIMER

        BSET 0,PORTA
S1HOP:  BRA STA1AD
HEADNEG:    BRCLR 6,POLAR,STA1AD    * Never had neg go back
        SUB #$03            * DON'T DECREMENT COUNTER IF AFTER
        CMP LPIR1           * SUBTRACTING 60 mVolts it is less
        BCS STA1AD          * than setpoint make come up more
        DEC NEGTHS          * Decrement negative threshold counter
        BNE S1HOP
        BSET 0,POLAR        * Set Out of Neg Threshold flag
        BRA S1HOP           * Go do it again

MVST2:  LDA #$F0
```

```
        AND STATE
        STA STATE
        BSET 0,PORTA
        CLR POLAR
        BRSET 0,TESTYP,STPALM   * If single tec PIR go alarm
        BSET 4,STATE
        BSET 4,ATIMER
        LDA TSR
        LDA ICRL
        LDA #$A1
        STA TCR                 * Enable Input Capture
STATE2: JSR STINVK              * Read Self Test, Kick Dog
        BRSET 4,ATIMER,RDS2UW
        BCLR 3,ATIMER           * CLEAR STATE 1 TIMER
        CLR STACNT
        CLR POLAR
        LDA #$E0                * Timed out restart
        AND STATE
        STA STATE
        JMP BCKGND              * Time out start over
RDS2UW:  BRCLR 7,UWAVE,STATE2  * Check for the confirming uWave
        BSET 1,PORTA
        BSET 0,ATIMER
STUWA:  CLR UWAVE               * jump in spot for single tec uWave
STPALM:  LDA #$80
        STA STATE               * alarm routine
        JSR CLERCT              * CLEAR ALL COUNTERS
        CLR POLAR               * Clear polariry reference
        BSET 7,ATIMER
        BSET 2,PORTA            * Drive Alarm
        BCLR 5,PORTB            * Drive Alarm Relay
        LDA #$20                * Alarm 4 Seconds
        STA ALRMCT

        JMP BCKGND

*******************SINGLE TEC MICROWAVE*****************
UWAV1:
        BRCLR 7,UWAVE,CHEKST    * HAD A UWAVE
        BRSET 0,UWAVE,STUWA     * Already had one
        BSET 0,UWAVE            * No indicate 1
        BSET 0,ATIMER           * start timer
        CLR UWAVC
        BCLR 7,UWAVE            * Clear flag
CHEKST:  JSR STINVK             * Check for CI or UI

CKOG:    LDA TSR                * Clear any flag
        LDA ICRL
        BSET 7,TCR              * Re-enable IC Interrupt
        BRSET 0,ATIMER,UWAV1    * DON'T ST IF pending alarm
        BCLR 0,UWAVE            * Timed out clear count
        BRCLR 5,STATE,UWAVI     * No Self Test Continue
        BCLR 7,TCR              * Disable input capture
```

```
        JMP CHKPWR              * st interval < tc + tc n/a
*************************************************************

PIRCHK:  LDX UPIR1              * Compare Upper Setpoints with self
        CPX UPIR2
        BNE SPFAIL
        CPX LPIR1               * Make sure Lower Setpoint is lower
        BCS SPFAlL
        LDX LPIR2
        CPX LPIR1
        BNE SPFAIL
        CPX UPIR2
        BCC SPFAIL
        TAX                     * SAVE COPY OF A/D SAMPLE
        CMP UPIR1
        BCC PIRAHI              * High alarm
        BRCLR 7,POLAR,CKLO      * No high did we have a high
        ADD #$03                * 60 mVolts hysteresis
        CMP UPIR1               * HIGER WHEN ADD 3
        BCC PIRRTS              * YES, LET DROP MORE DONT BOTHER *  *
                    WITH LOW SINCE HIGER WITH 3 ADDED
        DEC POSTHS              * NO decrement out of pos thres
        BNE CKLO                * Not out of thres yet
        BSET 1,POLAR            * Out of thres not out of time
CKLO:   TXA                     * RETRIEVE COPY IF NEEDED
        CMP LPIR1
        BCS PIRALO              * Low alarm
        BRCLR 6,POLAR,PIRRTS    * No low, haven't had one either
        SUB #$03                * 60 mVOLTS HYSTERESIS
        CMP LPIR1               * DONT DECREMENT IF LESS THAN WHEN
        BCS PIRRTS              * 60 mVOLTS ARE SUBTRACTED
        DEC NEGTHS              * Have had out of thres counter
        BNE PIRRTS
        BSET 0,POLAR
        BRA PIRRTS              * Process alarm
SPFAIL:  RSP                    * Go to Temp Comp try to recover
        BCLR 7,TCR              * Disable input capture
        JMP TMPCMP

PIRAHI:
        CLR PIRHIC
        BSET 1,ATIMER           * Start high threshold Timer
        LDA #$30                * Set Hysteresis Thres to 48
        STA POSTHS              * Positive Threshold Counter
        BSET 7,POLAR            * Positive Polarity Signal
        BRA PIRLED              * Restart counter
PIRALO:
        LDA #$30
        STA NEGTHS              * Set Hysteresis Thres to 48
                                * Negative Threshold counter
        BSET 6,NEGINF           * Negative Informer counter
        BSET 6,POLAR            * Negative Threshold counter
        CLR PIRLOC
```

```
        BSET 2,ATIMER            * Start Alarm Timer Counter
PIRLED:  BSET 0,PORTA            * Drive LED
        CLR UWAVNF               * Had a PIR clear uWave Informer
        CLR DELTIM               * Clear Delta Timer
        CLR DELTA                * Clear Delta Time Flag
        BCLR 6,STATE             * Clear RES
        CLR RESCTH               * Clear High byte of RES Counter
        BRSET 0,TESTYP,PIRRTS    * Single Tec PIR leave
        BRCLR 0,ATIMER,MLEDS     * If no uWave check LEDs
        CLR PIRCNT               * else clear PIR Inf.
        BSET 3,STATE             * State 1 had a uWave and PIR
MLEDS:
        BRCLR 1,STATE,PLED       * skip if no microwave informer
        BCLR 1,STATE             * Clear uWave Trouble
        BCLR 0,FAIL1             * Clear short ST Mode
*****************************************************************
        BCLR 6,TRBSTA            * CLEAR INFORMER TROUBLE LATCH
*****************************************************************

        CLR LEDS
        CLR FLASH
        CLR PORTA
PLED:   BSET 0,PORTA
PIRRTS:  RTS

PIRINF:  BRSET 0,TESTYP,NPIRIC      * If Single Tec no Informer
* PIRN:  RTS                     * REMOVE GTEM STATEMENT NO INFORM
        DEC NEGINF               * Decrement Counter
        BNE NPIRIC
        INC PIRCNT               * Increment Informer
        LDA #$0F                 * Compare Informer Count to 16
        CMP PIRCNT               * If 16:1 drive trouble with code
        BCC NPIRIC
        STA PIRCNT               * Keep count at 16
        JSR CLERCT
        BSET 0,STATE             * PIR Trouble
        BCLR 3,TESTYP            * Clear any temp comp error
        BCLR 4,TSTAT
        LDA #$05                 * Put out error Code
        STA FLASH
        STA LEDS
*****************************************************************
        BRSET 6,TRBSTA,NOPRTR
        BSET 6,TRBSTA            * SET FLAG TO PULSE FOR 4 SECONDS
        BSET 5,TROUB             * PULSE FOR 4 SECONDS
        BSET 3,PORTA
*****************************************************************
NOPRTR:  BRSET 1,FAIL1,NPIRIC * If already in short mode skip
        BSET 1,FAIL1             * else set in short st mode
        BSET 5,STATE             * do an immediate st
        CLR STIMM                * clear significant st counters
        CLR STIMH
NPIRIC:  RTS
```

```
CLERCT:  CLR ATIMER
         CLR PIRHIC
         CLR PIRLOC
         CLR STACNT
         CLR STA2C
         CLR UWAVC
         RTS

RDATOD:  CLRA
         LDX #$02                  * Read A/D twice & divide by two
         BCLR 7,ADSCR              * START A/D
AGATOD:  BRCLR 7,ADSCR,AGATOD
         ADD ADDR
         DEX
         BNE AGATOD
         RORA
         RTS
         END


*************************************************************
*        Delay Subroutine Decrements Accumulator by 255     *
*        times whats in the index register. Must lode       *
*        prior to calling the routine                       *
*        Do not move this routine.                          *
*                                                           *
*************************************************************

         XDEF DELAY
         XREF PSCT:COP

         ORG $0032            * ZERO PAGE ROM CRUNCH
DELAY:
Out1:    CLRA                 * A at Zero 3
         STA COP              * Kick Dog 5
In1:     DECA                 * 3 x .5 uSec 256 x 6 =
         BNE In1              * 3 x .5 uSec .8 mSec
         DECX                 * 3 x .5 uSec 3 X x (.8 + .007)mSec
         BNE Out1             * 3 x .5 uSec 3
         RTS                  * Return from subroutine

         END
```

```
*****************************************************************
*     Self Test Invoke Subroutine used for Command Input        *
*     and User Invoking -- User Invoked performs the same       *
*     as Command Input but shows (then clears) any stored       *
*     error code first (for 10 seconds) before jumping to       *
*     the beginning of self test, Command Input jumps write     *
*     into the begginning of Self Test                          *
*     The display codes are held in look up tables on zero      *
*     page ROM starting at location $20 as LED code Flash       *
*     code. The error code is the actual address of the         *
*     LED code to be displayed. The flash code is one above     *
*     it.                                                       *
*                                                               *
*****************************************************************

      XREF BSCT:TESTYP,ERCODE,TTIME,PORTC,TCR
      XREF PSCT:INIT,COP
      XREF BSCT:LEDRIV
      XDEF STINVK


STINVK:  CLRA                  * kick the dog
      STA COP
      BRSET 0,PORTC,CKCMD      * No User Invoke check CI
      BSET 7,TESTYP            * Indicate that now in Self Test
      LDX ERCODE               * Get the error code
      BEQ JMTST                * No error code just do test
      JSR LEDRIV               * go put out proper error code
      LDA #$15                 * get the display time
      STA TTIME
ERWAIT:  CLRA
      STA COP                  * Hit Dog
      TST TTIME                * wait delay period
      BNE ERWAIT
SHORT2:  STA COP               * Hit Dog
      BRSET 0,PORTC,SHORT2     * Now wait for 2nd short to ST
      BRA JMTST                * go run destructive ST
CKCMD:  BRSET 1,PORTC,RTTST    * no Command Input return
JMTST:  BCLR 7,TCR
SELF:   BRA SELF               * els run detructive ST check Dog

RTTST:  RTS                    * Return from subroutine


      END


      XREF BSCT:TSTAT,TESTYP,FAlL1,ERCODE,STATE
*     XREF PSCT:LEDRIV
      XDEF IRQ

*     By the fact that the processor is in this routine means
*     there was an error Microwave Supervision Routine
```

The following component values have been found satisfactory for an operative embodiment of the invention. Unless otherwise specified all resistor values are in ohms, one-tenth watt, ±5% tolerance. Unless otherwise specified all capacitor values are in microfarads, ±20% tolerance, 50 working volts DC:

```
*****************************************************************
*     Self Test Invoke Subroutine used for Command Input        *
*     and User Invoking -- User Invoked performs the same       *
*     as Command Input but shows (then clears) any stored       *
*     error code first (for 10 seconds) before jumping to       *
*     the beginning of self test, Command Input jumps write     *
*     into the begginning of Self Test                          *
*     The display codes are held in look up tables on zero      *
*     page ROM starting at location $20 as LED code Flash       *
*     code. The error code is the actual address of the         *
*     LED code to be displayed. The flash code is one above     *
*     it.                                                       *
*                                                               *
*****************************************************************

      XREF BSCT:TESTYP,ERCODE,TTIME,PORTC,TCR
      XREF PSCT:INIT,COP
      XREF BSCT:LEDRIV
      XDEF STINVK


STINVK:  CLRA                  * kick the dog
      STA COP
      BRSET 0,PORTC,CKCMD      * No User Invoke check CI
      BSET 7,TESTYP            * Indicate that now in Self Test
      LDX ERCODE               * Get the error code
      BEQ JMTST                * No error code just do test
      JSR LEDRIV               * go put out proper error code
      LDA #$15                 * get the display time
      STA TTIME
ERWAIT:  CLRA
      STA COP                  * Hit Dog
      TST TTIME                * wait delay period
      BNE ERWAIT
SHORT2:  STA COP               * Hit Dog
      BRSET 0,PORTC,SHORT2     * Now wait for 2nd short to ST
      BRA JMTST                * go run destructive ST
CKCMD:  BRSET 1,PORTC,RTTST    * no Command Input return
JMTST:  BCLR 7,TCR
SELF:   BRA SELF               * els run detructive ST check Dog

RTTST:  RTS                    * Return from subroutine


      END


      XREF BSCT:TSTAT,TESTYP,FA1L1,ERCODE,STATE
*     XREF PSCT:LEDRIV
      XDEF IRQ

*     By the fact that the processor is in this routine means
*     there was an error Microwave Supervision Routine
```

```
*
IRQ:
      BSET 5,FAIL1            * had one error indicate
                              * it to Chkpwr routine
      BSET 5,STATE            * Do an immediate self test
                              * once returned to Background
      RTI

      END


      XREF PSCT:TIMER,IRQ,lNIT
*     Interrupt and Reset Vectors
*     Also ROM Check sum and COP Regesiter Code
*
VECS:
      ORG $08FF
      FCB $49                 * EOR OF ROM
*     ORG $0900               * Mask Option Register
      FCB $01                 * IRQ Edge
                              * COP Disabled
      ORG $1FF0

      FCB $0                  * COP Address is $1FF0
      FCB 0,0,0,0,0,0,0       * 7 zeros unused area
      FDB TIMER               * Location $1FF8 & $1FF9
      FDB IRQ                 * External Interupt FA FB
      FDB INIT                * SWI Vector $1FFC & FD
      FDB INIT                * Reset Vector Jump to Init

      END
```

COMPONENTS

| Reference No | Type | Value or Part Number |
|---|---|---|
| 12 | microcontroller | MC68HC705P9 |
| 15 | capacitor | 100 pF |
| 16 | capacitor | 470, 25 WVDL |

| | | |
|---|---|---|
| 18 | suppressor | P6KE20C |
| 20 | diode | 1N5818 |
| 22 | voltage regulator | S-81250PG |
| 23 | resistor | 3K |
| 24 | transistor | 2N6726 |
| 25 | zener diode | 1N5234 |
| 26 | resistor | 12K |
| 27 | capacitor | 1000 pF |
| 28 | resistor | 1K |
| 29 | capacitor | 1000 pF |
| 30,48 | operational amplifier | LM3508 |
| 32 | diode | 1N914B |
| 34 | resistor | 3K |
| 38 | capacitor | 220,25WVDC |
| 39 | resistor | 1K |
| 40 | resistor | 11.3K, 1% |
| 42 | potentiometer | 5K, 20% |
| 43 | capacitor | 100 pt |
| 44 | resistor | 20K, 1% |
| 45 | capacitor | 1000 pF |
| 46 | resistor | 1K |
| 49 | capacitor | .01 |
| 50 | transistor | 2N3904 |
| 52 | resistor | 3K |
| 54 | resistor | 12K |
| 56 | resistor | 1K |
| 57 | capacitor | 1000 pF |
| 58 | capacitor | 100,10WVDC |
| 62 | capacitor | .01 |
| 66 | passive infrared detector | Heiman LHI 958-3890 |
| 68 | resistor | 1K |
| 69 | capacitor | .01 |
| 70 | resistor | 390 |
| 72,82 | operational amplifier | LM358 |
| 74 | resistor | 47K |
| 76 | capacitor | 100 pF |
| 78 | capacitor | 47, 25 WVDC |
| 80 | resistor | 12.1K, 1% |
| 83 | capacitor | 100 pF |
| 84 | resistor | 1 Meg, 1% |
| 86 | capacitor | .01 |
| 88 | resistor | 402K, 1% |
| 90 | capacitor | .027 |
| 92 | resistor | 8.25K, 1% |
| 94 | capacitor | 100, 10 WVDC |
| 96 | capacitor | .01 |
| 98 | resistor | 787K, 1% |
| 100 | resistor | 787K, 1% |

| | | |
|---|---|---|
| 102 | resistor | 1K |
| 104 | capacitor | .01 |
| 108 | resistor | 1K |
| 109 | resistor | 1K |
| 110 | resistor | 20K, 1% |
| 112 | resistor | 43.2K, 1% |
| 113 | capacitor | 0.1 |
| 114 | resistor | 10K, 1% |
| 116 | resistor | 1K |
| 118,120, | operational | LM339 |
| 122,176 | amplifier | LM393 |
| 124,260 | operational amplifier | |
| 128 | LED (green) | |
| 129 | resistor | 1.2K, 1/8 watt |
| 130 | LED (yellow) | |
| 131 | resistor | 1.2K, 1/8 watt |
| 134 | LED (red) | |
| 135 | resistor | 1.2K |
| 138 | resistor | 110K, 1/2 watt |
| 140 | resistor | 1 Meg |
| 142,144 | diodes | IN914 |
| 148 | capacitor | 100 pF |
| 150 | capacitor | .01 |
| 151 | resistor | 10K |
| 153 | capacitor | .01 |
| 154 | resistor | 10K |
| 156 | transistor | 2N3904 |
| 157 | resistor | 1K, 1/2 watt |
| 159 | zener diode | P6E18A |
| 166 | resistor | 1K |
| 168 | resistor | 100K |
| 170 | capacitor | 1.0 |
| 184 | resistor | 10K |
| 186 | resistor | 10K |
| 188 | resistor | 10K |
| 192 | resistor | 10K |
| 194 | transistor | 2N3904 |
| 196 | transistor | 2N3906 |
| 197 | diode | 1N914B |
| 200 | relay reed | 1 amp, 5 volt 500 ohm coil |
| 204 | resistor | 3K |
| 206 | resistor | 100K |
| 208 | zener diode | 1N5234 |
| 214 | diode | 1N914B |
| 216 | varistor | 30 volt, 0.25 watt |
| 218 | varistor | 30 volt, 0.25 watt |
| 222 | resistor | 10K |
| 226 | transistor | 2N3904 |
| 228 | resistor | 10K |
| 230 | capacitor | 100 pF |
| 232 | resistor | 10K |

It is apparent from the foregoing that a new and improved method and system have been provided for intrusion detection using multiple types of sensors. While only certain preferred embodiments have been described in detail, as will be apparent to those familiar with the art, certain changes and or modifications can be made without departing from the scope of the invention as defined by the following claims.

I claim:

1. An intrusion detection system comprising:

a first detecting means for detecting an intrusion in a volume of space by a first physical phenomenon and for generating a first signal in response to each detection of said intrusion;

a second detecting means for detecting an intrusion in said volume of space by a second physical phenomenon different from the first phenomenon, for generating a second signal in response to the detection of said intrusion; and logic means for generating an alarm signal in response to the occurrence of one first signal in response to one detection and one second signal in response to one detection within a first interval, the occurrence of another first signal within a second interval said second interval subsequent to said first interval, and the occurrence of another second signal in response to another detection within a third interval said third interval subsequent to said second interval.

2. The system of claim 1 wherein said first detecting means comprises:

a passive infrared detector.

3. The system of claim 2 wherein said second detecting means comprises:

a microwave detector.

4. The system of claim 1 wherein said first detecting means comprises:

a microwave detector.

5. The system of claim 4 wherein said second detecting means comprises:

a passive infrared detector.

6. The system of claim 1 wherein said logic means comprises a microcontroller.

7. The system of claim 1 wherein said logic means for generating an alarm signal further comprises:

timing means for limiting the duration of said alarm signal.

8. A method of detecting an intrusion within a volume of space comprising the steps of:

detecting an intrusion within a volume of space by a first physical phenomenon;

generating a first signal in response to the detection of said intrusion by said first physical phenomenon;

detecting an intrusion within said volume of space by a second physical phenomena, different from the first phenomena;

generating a second signal in response to the detection of said intrusion by said second physical phenomena;

generating an alarm signal in response to the occurrence of one first signal and one second signal within a first interval, the occurrence of another first signal within a second interval said second interval subsequent to said first interval, and the occurrence of another second signal within a third interval said third interval subsequent to said second interval.

9. The method of claim 8 wherein said first physical phenomena is infrared radiation.

10. The method of claim 9 wherein said second physical phenomenon is doppler shift microwave radio frequency.

11. The method of claim 8 wherein said first physical phenomenon is doppler shift.

12. The method of claim 11 wherein said second physical phenomenon is infrared radiation.

13. The method of claim 8 further comprising the step of:

limiting the duration of the alarm signal.

14. An intrusion detection system comprising:

a first sensor for sensing an intrusion in a volume of space by a first physical phenomenon and for generating a first signal in response to the detection of said intrusion;

a second sensor for sensing an intrusion in said volume of space by a second physical phenomenon different from the first phenomenon, for generating a second signal in response to the detection of said intrusion; and a microcontroller for generating an alarm signal in response to the occurrence of one first signal and one second signal within a first interval, the occurrence of another first signal within a second interval said second interval subsequent to said first interval, and the occurrence of another second signal within a third interval said third interval subsequent to said second interval.

15. The system of claim 14 wherein said first sensor comprises:

a passive infrared detector.

16. The system of claim 15 wherein said second sensor comprises:

a passive infrared detector.

17. The system of claim 14 wherein said first sensor comprises:

a microwave detector.

18. The system of claim 17 wherein said second sensor comprises:

a passive infrared detector.

19. A method of detecting an intrusion within a volume of space comprising the steps of:

detecting an intrusion within a volume of space by a first physical phenomenon;

generating a first signal in response to the detection of said intrusion by said first physical phenomenon;

detecting an intrusion within said volume of space by a second physical phenomena, different from the first phenomena;

generating a second signal in response to the detection of said intrusion by said second physical phenomena;

generating an alarm signal in response to the occurrence of at least one first signal and at least one second signal within a first interval, the occurrence of one of another first signal and another second within a second interval said second interval subsequent to said first interval, and the occurrence of one of another first signal and another second signal within a third interval said third interval subsequent to said second interval.

20. An intrusion detection system comprising:

a first detecting means for detecting an intrusion in a volume of space by a first physical phenomenon and for generating a first signal in response to each detection of said intrusion;

a second detecting means for detecting an intrusion in said volume of space by a second physical phenomenon different from the first physical phenomenon and for generating a second signal in response to the detection of said intrusion; and logic means for generating an alarm signal in response to the occurrence of one first signal in response to one detection and one second signal in response to one detection within a first interval of time; and the logic means also generating an alarm signal in response to the occurrence of a plurality of first signals generated within a second interval of time.

21. The system of claim 20 wherein said first detecting means comprises:

a passive infrared detector.

22. The system of claim 21 wherein said second detecting means comprises:

a microwave detector.

23. The system of claim 20 wherein said first detecting means comprises:

a microwave detector.

24. The system of claim 23 wherein said second detecting means comprises:

a passive infrared detector.

25. The system of claim 20 wherein said logic means comprises a microcontroller.

26. The system of claim 20 wherein said logic means for generating an alarm signal further comprises:

timing means for limiting said alarm signal in duration.

27. A method of detecting an intrusion within a volume of space comprising the steps of:

detecting an intrusion within a volume of space by s first physical phenomenon;

generating a first signal in response to the detection of said intrusion by said first physical phenomenon;

detecting an intrusion within said volume of space by a second physical phenomenon;

generating a second signal in response to the detection of said intrusion by said second physical phenomenon;

generating an alarm signal in response to the occurrence of one first signal and one second signal within a first interval of time; and generating an alarm signal in response to the occurrence of a plurality of first signals generated within a second interval of time.

28. The method of claim 27 wherein said first physical phenomena is infrared radiation.

29. The method of claim 25 wherein said second physical phenomenon is doppler shift microwave radio frequency.

30. The method of claim 27 wherein said first physical phenomenon is doppler shift.

31. The method of claim 30 wherein said second physical phenomenon is infrared radiation.

32. The method of claim 27 further comprising the step of:

limiting the alarm signal in duration.

33. An intrusion detection system comprising:

a first sensor for sensing an intrusion in a volume of space by a first physical phenomenon and for generating a first signal in response to the detection of said intrusion;

a second sensor for sensing an intrusion in said volume of space by a second physical phenomenon different from the first physical phenomenon and for generating a second signal in response to the detection of said intrusion; and a microcontroller for generating an alarm signal in response to the occurrence of one first signal and one second signal in response to one detection within a first interval of time; and the microcontroller also generating an alarm signal in response to the occurrence of a plurality of first signals generated within a second interval of time.

34. The system of claim 33 wherein said first sensor comprises:

a passive infrared detector.

35. The system of claim 34 wherein said second sensor comprises:

a passive infrared detector.

36. The system of claim 33 wherein said first sensor comprises:

a microwave detector.

37. The system of claim 36 wherein said second sensor comprises:

a passive infrared detector.

38. A method of detecting an intrusion within a volume of space comprising the steps of:

detecting an intrusion within a volume of space by s first physical phenomenon;

generating s first signal in response to the detection of said intrusion by said first physical phenomenon;

detecting an intrusion within said volume of space by a second physical phenomenon, different from the first phenomenon;

generating a second signal in response to the detection of said intrusion by said second physical phenomenon;

generating an alarm signal in response to the occurrence of at least one first signal and at least one second signal within a first interval of time; and generating an alarm signal in response to the occurrence of a plurality of first signals generated within a second interval of time.

* * * * *

UNITED STATES PATENT AND TRADEMARK OFFICE

CERTIFICATE OF CORRECTION

PATENT NO. : 5,475,365
DATED : December 12, 1995
INVENTOR(S) : Paul M. Hoseit, et. al.

It is certified that error appears in the above-indentified patent and that said Letters Patent is hereby corrected as shown below:

In Col. 85, Claim 27, Line 3 "s" should be "a."

In Col. 86, Claim 38, Line 3, "s" should be "a."

In Col. 86, Claim 38, Line 5, "s" should be "a."

Signed and Sealed this

Ninth Day of April, 1996

Bruce Lehman

*Attest:*

BRUCE LEHMAN

*Attesting Officer*

*Commissioner of Patents and Trademarks*